US006172661B1

(12) United States Patent
Imajo et al.

(10) Patent No.: US 6,172,661 B1
(45) **Date of Patent: *Jan. 9, 2001**

(54) LOW POWER DRIVING METHOD FOR REDUCING NON-DISPLAY AREA OF TFT-LCD

(75) Inventors: Yoshihiro Imajo; Hironori Kondo, both of Mobara; Kaoru Hasegawa, Ichinomiya-machi; Youichi Igarashi, Mobara, all of (JP)

(73) Assignee: Hitachi, Ltd., Tokyo (JP)

( * ) Notice: Under 35 U.S.C. 154(b), the term of this patent shall be extended for 0 days.

This patent is subject to a terminal disclaimer.

(21) Appl. No.: 09/260,554

(22) Filed: Mar. 2, 1999

Related U.S. Application Data

(63) Continuation of application No. 08/498,459, filed on Jul. 5, 1995, now Pat. No. 5,877,736.

(30) Foreign Application Priority Data

Jul. 8, 1994 (JP) ..... 6-156869
Jul. 8, 1994 (JP) ..... 6-156870
Jul. 8, 1994 (JP) ..... 6-156871
Jul. 8, 1994 (JP) ..... 6-156872
Jul. 8, 1994 (JP) ..... 6-156873

(51) Int. Cl.[7] ..... G09G 3/36
(52) U.S. Cl. ..... 345/89; 345/95
(58) Field of Search ..... 345/87, 89, 92, 345/94, 95, 52, 50; 349/33, 34, 42

(56) References Cited

U.S. PATENT DOCUMENTS 4,906,984 3/1990 Takeda et al. .
5,196,738 3/1993 Takahara et al. ..... 345/95
5,250,937 10/1993 Kikuo et al. .
5,414,443 5/1995 Kanatani et al. ..... 345/95
5,489,917 2/1996 Ikezaki et al. .
5,623,278 4/1997 Okada et al. ..... 345/95

FOREIGN PATENT DOCUMENTS 0514033 11/1992 (EP) ..... 345/95

*Primary Examiner*—Chanh Nguyen
(74) *Attorney, Agent, or Firm*—Antonelli, Terry, Stout & Kraus, LLP

(57) ABSTRACT

A liquid crystal display device includes a liquid crystal display panel in which pixels are arranged in rows and columns. Each of the pixels includes a pixel electrode, and a thin-film transistor having a gate electrode and a drain electrode. Gate signal lines arranged in the rows are connected to the gate electrodes of the thin-film transistors. Drain signal lines arranged in the columns are connected to the drain electrodes of the thin-film transistors. The liquid crystal display device further includes a gate drive circuit for driving the gate signal lines, and a drain drive circuit for driving the drain signal lines. The drain drive circuit receives a plurality of grey-scale reference voltages from an external circuit, interpolates a plurality of intermediate voltages between each pair of adjacent ones of the grey-scale reference voltages, selects voltages from the grey-scale reference voltages and the intermediate voltages, and applies the selected voltages to the drain signal lines. V0 is a grey-scale reference voltage corresponding to a minimum grey-scale level, Vm is a grey-scale reference voltage corresponding to a maximum grey-scale level, and Vi is a grey-scale reference voltage that is nearest to a voltage level (Vm+V0)/2. A number of intermediate voltages interpolated between V(i−1) and Vi is different from both a number of intermediate voltages interpolated between V0 and V1, and a number of intermediate voltages interpolated between V(m−1) and Vm.

8 Claims, 41 Drawing Sheets

FIG. 16

| Input of Decoder | | | | | | Output of Decoder | | | | | |

FIG. 30

| | | | | | | | |
|---|---|---|---|---|---|---|---|
| ◎ | ☆ | 0 | 0 | 0 | 0 | 0 | 0 |
| | | 0 | 0 | 0 | 0 | 0 | 1 |
| | | 0 | 0 | 0 | 0 | 1 | 0 |
| | | 0 | 0 | 0 | 0 | 1 | 1 |
| ◎ | ☆ | 0 | 0 | 0 | 1 | 0 | 0 |
| | | 0 | 0 | 0 | 1 | 0 | 1 |
| | | 0 | 0 | 0 | 1 | 1 | 0 |
| | | 0 | 0 | 0 | 1 | 1 | 1 |
| ◎ | ☆ | 0 | 0 | 1 | 0 | 0 | 0 |
| | | 0 | 0 | 1 | 0 | 0 | 1 |
| | | 0 | 0 | 1 | 0 | 1 | 0 |
| | | 0 | 0 | 1 | 0 | 1 | 1 |
| ◎ | ☆ | 0 | 0 | 1 | 1 | 0 | 0 |
| | | 0 | 0 | 1 | 1 | 0 | 1 |
| | | 0 | 0 | 1 | 1 | 1 | 0 |
| | | 0 | 0 | 1 | 1 | 1 | 1 |
| ◎ | | 0 | 1 | 0 | 0 | 0 | 0 |
| | ☆ | 0 | 1 | 0 | 0 | 0 | 1 |
| | | 0 | 1 | 0 | 0 | 1 | 0 |
| | | 0 | 1 | 0 | 0 | 1 | 1 |
| ◎ | | 0 | 1 | 0 | 1 | 0 | 0 |
| | ☆ | 0 | 1 | 0 | 1 | 0 | 1 |
| | | 0 | 1 | 0 | 1 | 1 | 0 |
| | | 0 | 1 | 0 | 1 | 1 | 1 |
| ◎ | | 0 | 1 | 1 | 0 | 0 | 0 |
| | ☆ | 0 | 1 | 1 | 0 | 0 | 1 |
| | | 0 | 1 | 1 | 0 | 1 | 0 |
| | | 0 | 1 | 1 | 0 | 1 | 1 |
| ◎ | | 0 | 1 | 1 | 1 | 0 | 0 |
| | ☆ | 0 | 1 | 1 | 1 | 0 | 1 |
| | | 0 | 1 | 1 | 1 | 1 | 0 |
| | | 0 | 1 | 1 | 1 | 1 | 1 |

| | | | | | | | |
|---|---|---|---|---|---|---|---|
| ◎ | | 1 | 0 | 0 | 0 | 0 | 0 |
| | | 1 | 0 | 0 | 0 | 0 | 1 |
| | ☆ | 1 | 0 | 0 | 0 | 1 | 0 |
| | | 1 | 0 | 0 | 0 | 1 | 1 |
| ◎ | | 1 | 0 | 0 | 1 | 0 | 0 |
| | | 1 | 0 | 0 | 1 | 0 | 1 |
| | ☆ | 1 | 0 | 0 | 1 | 1 | 0 |
| | | 1 | 0 | 0 | 1 | 1 | 1 |
| ◎ | | 1 | 0 | 1 | 0 | 0 | 0 |
| | | 1 | 0 | 1 | 0 | 0 | 1 |
| | ☆ | 1 | 0 | 1 | 0 | 1 | 0 |
| | | 1 | 0 | 1 | 0 | 1 | 1 |
| ◎ | | 1 | 0 | 1 | 1 | 0 | 0 |
| | | 1 | 0 | 1 | 1 | 0 | 1 |
| | ☆ | 1 | 0 | 1 | 1 | 1 | 0 |
| | | 1 | 0 | 1 | 1 | 1 | 1 |
| ◎ | | 1 | 1 | 0 | 0 | 0 | 0 |
| | | 1 | 1 | 0 | 0 | 0 | 1 |
| | | 1 | 1 | 0 | 0 | 1 | 0 |
| | ☆ | 1 | 1 | 0 | 0 | 1 | 1 |
| ◎ | | 1 | 1 | 0 | 1 | 0 | 0 |
| | | 1 | 1 | 0 | 1 | 0 | 1 |
| | | 1 | 1 | 0 | 1 | 1 | 0 |
| | ☆ | 1 | 1 | 0 | 1 | 1 | 1 |
| ◎ | | 1 | 1 | 1 | 0 | 0 | 0 |
| | | 1 | 1 | 1 | 0 | 0 | 1 |
| | | 1 | 1 | 1 | 0 | 1 | 0 |
| | ☆ | 1 | 1 | 1 | 0 | 1 | 1 |
| ◎ | | 1 | 1 | 1 | 1 | 0 | 0 |
| | | 1 | 1 | 1 | 1 | 0 | 1 |
| | | 1 | 1 | 1 | 1 | 1 | 0 |
| | ☆ | 1 | 1 | 1 | 1 | 1 | 1 |

◎ : The group of grey-scale levels in conventional art.

☆ : The group of grey-scale levels in present invention.

| FIG. 33 | FIG. 34 |
|---|---|

| FIG. 37 | FIG. 38 |
|---|---|

LOW POWER DRIVING METHOD FOR REDUCING NON-DISPLAY AREA OF TFT-LCD

CROSS-REFERENCE TO RELATED APPLICATION

This application is a continuation of application Ser. No. 08/498,459 filed on Jul. 5, 1995, now U.S. Pat. No. 5,877,736.

PRIOR ART

A TFT liquid crystal display module has been known as one of TFT liquid crystal displays.

FIG. 39 is a block diagram showing the outline configuration of the conventional TFT liquid crystal display module.

In FIG. 39, a liquid crystal display panel (TFT-LCD) has 640×3×480 pixels and drain drivers 511 arranged at the top and bottom of the liquid crystal display panel (TFT-LCD). The top and bottom drain drivers 511 are alternately connected to drain lines (D) of the thin-film transistors TFT to supply a liquid crystal drive voltage to the thin-film transistors TFT.

Gate lines (G) of the thin-film transistors TFT are connected with gate drivers 506 arranged by the side of the liquid crystal display panel (TFT-LCD) that supply a voltage to the thin-film transistors TFT for one horizontal operation duration.

A display controller 501 comprising one semiconductor integrated circuit (LSI) receives display data and display control signals from the computer and, based on the received signals, drives the drain drivers 511 and the gate drivers 506.

In this process, the display data from the computer are transferred one set in each unit time, the one set comprising red (R), green (G) and blue (B) data and forming one pixel.

The display data has either 12 bits, 4 for each color, or 18 bits, 6 for each color.

Because the drain drivers 511 are provided at the top and the bottom, there are provided two systems of both the control signal bus and the display data bus for sending drive outputs to the drain drivers 511.

FIG. 40 is a block diagram showing the outline configuration of the drain driver 511 of the conventional TFT liquid crystal display module.

As shown in FIG. 40, the drain driver 511 consists of a data latch unit 551 for display data and an output voltage generation circuit 552.

The drain driver 511 of FIG. 40 is supplied 6-bit display data and 9-value grey-scale reference voltage and produces 64 levels of output voltage.

The data latch unit 551 takes in the same number of display data as that of output lines in synchronism with the data latch clock signal (CL1), and the output voltage generation circuit 552 selects an output voltage corresponding to the display data from the data latch unit 551 from among the 64 grey-scale output voltages generated from the externally supplied grey-scale reference voltage and outputs the selected voltage to the drain signal line.

FIG. 41 shows the circuit configuration of the output voltage generation circuit 552 of the drain driver 511 of the conventional liquid crystal display module. The figure represents only one of the output voltage generation circuits 552, which are provided in number equal to that of the drain signal lines.

As shown in FIG. 41, the output voltage generation circuit divides each of the voltages (V0–V8) between the nine external grey-scale reference voltage values into eight equal sections (VO0–VO64), which are selected and output by a decoder 553.

FIG. 42 shows the relation between the grey-scale reference voltages of FIG. 41 and the output voltages.

In FIG. 42 a total of 65 output voltage values are obtained, of which V064 equal to V8 is not used.

FIELD OF INDUSTRIAL APPLICATION

The present invention relates to a liquid crystal display device and more particularly to a technology effectively applied to thin-film transistor (TFT) liquid crystal displays.

PROBLEM TO BE SOLVED BY THE INVENTION

It is known from U.S. Pat. No. 4,906,984 that, by adopting as a common electrode drive method for the TFT liquid crystal display module a common electrode AC drive method which converts the voltage applied to the common electrode into an AC voltage, it is possible to use a drain driver with a low withstand voltage.

The conventional common electrode AC drive method has a first drawback; that is, the use of a square wave form as an AC wave form causes a large peak current when a phase is switched, so the common electrode drive transistor needs to have a large current rating, which in turn increases the size of the drive circuit.

In the drive circuit of the TFT liquid crystal display, we can use a level shift circuit of a differential amplifier type.

In the level shift circuit of the differential amplifier type, when noise is superimposed on a positive power supply, it is also fed to the power supply output terminal. Because the noise superimposed on the positive power supply line has a different wave form than the noise transmitted to the output terminal, there is a second drawback that the buffer circuit, which is connected behind the level shift circuit and operates on the positive power supply as the reference, will malfunction.

Further, it is known from U.S. Pat. No. 5,250,937 that, by changing the voltage applied between the pixel electrode and an opposing electrode of the liquid crystal, the viewing angle can be adjusted. With the conventional TFT liquid crystal display module, the voltage applied to the drain signal line is changed to adjust the viewing angle.

Generally, in the TFT liquid crystal display module that performs the common electrode AC drive, there is a third drawback that the viewing angle adjustment by changing the voltage applied to the drain signal line (D) results in a complicated circuit configuration.

The relation between applied voltage and transmission factor of a liquid crystal is generally nonlinear as a typical example shows in FIG. 43.

As shown in FIG. 43, the applied voltage-transmission factor characteristic is significantly nonlinear at the ends of the voltage range used and relatively linear at the center.

Normally, a desired linear grey-scale display can be obtained by supplying the drain driver with the voltage value that is corresponding to this nonlinearity.

With the drain driver 511 which generates the voltage values (VO0–VO64) by dividing each of the nine external grey-scale reference voltages (V0–V8) into eight equal parts and which selects and outputs one of the 64 shade level voltages, As shown in FIG. 42, however, there are only eight shade levels out of the 64 from which the user can arbitrarily select to set the output voltage.

The shade level voltages internally generated by the drain driver 511 are produced by equally dividing each of the external grey-scale reference voltages for the sake of versatility of the drain driver 511 and of simplification of its internal circuit.

For this reason, there is a fourth drawback that the shade level voltages internally generated by the drain driver 511 deviate from the linear voltages intended to be used to produce a desired grey-scale display.

Although the effects of the above-mentioned deviation are not so significant in the central portion of the voltage range that exhibits a relatively linear characteristic, they cannot be ignored at the ends of the voltage range where significant nonlinearity is observed and it is not possible to produce a good grey-scale display characteristic.

While this deviation may be reduced by increasing the number of external grey-scale reference voltages, this method has a problem of increasing the number of input leads of the drain driver 511 and complicating the configuration of the external circuit for driving the drain drivers 511. This method, therefore, is not practical.

With the technique shown in FIG. 39, there is a fifth drawback that because the drain drivers 511 are arranged at the top and bottom of the liquid crystal display panel (TFT-LCD), the frame edge portions at the upper and lower portions of the TFT liquid crystal display module are required to be equal in lengths (areas).

The market needs, however, larger displays in smaller frames.

In the above-mentioned conventional technique, all the drain drivers 511 are driven by the clock signal from the display controller 501 alone.

In this case, when the number of drain drivers 511 becomes large, there is a sixth drawback that the buffer circuit 210 may become unable to drive the drain drivers 511 with the result that stable clock signals may not be supplied.

The power consumption of an AC component of the signal output from the semiconductor integrated circuit can generally be expressed as follows.

$$p=fcv_2[W] \quad \text{[Equation 1]}$$

where f is operating frequency [Hz], c is output capacitance [F] and v is voltage of AC component [V].

Therefore, as the number of terminals from the display controller 501 of the TFT liquid crystal display module increases or the load capacitance of output increases, the power consumption becomes large to that extent.

In the display controller 501 of the TFT liquid crystal display module, the AC power consumption at the output terminals for drivers (several hundred mW) is greater than the power consumed by the internal circuit (several tens of mW).

The display controller 501 of the TFT liquid crystal display module uses a surface-mount LSI in a plastic package, whose allowable power consumption is about 500 mW.

The TFT liquid crystal display module is characterized by its vividness and high response speed (rise time+fall time= about 50 ns). Because of these features there are demands for this module to have increased number of shade levels, higher resolution, and enhanced performance.

Increasing the number of shade levels (colors) or increasing the number of drain drivers 511 and gate drivers 506 as the number of pixels increases will result in an increased power consumption at the output of the display controller 501 of the TFT liquid crystal display module.

For example, to deal with an increased number of shade levels, when a large number of drain drivers 511 are used for 64 shade levels of each color (262, 144 colors in all) and when multiple buses are introduced for higher resolution driving, the power consumption may exceed the allowable power consumption of the semiconductor integrated circuit (LSI) package.

As a result, the package of a semiconductor integrated circuit (LSI) produces a substantial amount of heat leading to its destruction. This is a seventh drawback.

An eighth drawback is that the I/F connector of the TFT liquid crystal display module is used only for input of display data and synchronizing signals and that it is not easy to make internal adjustment and know the setting state of the module.

A ninth drawback is that, with the method of converting the display data for the difference of bit numbers between a computer and a TFT liquid crystal display module, for example, the display data which are supplied from the computer and have four bits assigned for each color, into display data having six bits for each color used in the TFT liquid crystal display module, it is not possible to display 100% white or black.

A first objective of this invention is to provide a technology for a common electrode AC drive method in the TFT liquid crystal display which can suppress the peak current flowing in the drive transistor and thereby reduce the external size of the TFT liquid crystal display.

A second objective of this invention is to provide a technology in the TFT liquid crystal display that can prevent malfunctions caused by noise of a circuit provided behind the level shift circuit.

In the TFT liquid crystal display that performs a common electrode AC drive, a third objective of this invention is to provide a technology which enables easy adjustment of viewing angle.

In the TFT liquid crystal display, a fourth objective of this invention is to provide a technology which permits good grey-scale display.

In the TFT liquid crystal display, a fifth objective of this invention is to provide a technology which allows the display area to be made large compared with the external dimension of the liquid crystal display device.

In the TFT liquid crystal display, a sixth objective of this invention is to provide a technology which can supply a stable lock signal even when the number of drain drivers 511 as a load becomes large.

In the TFT liquid crystal display, a seventh objective of this invention is to provide a technology which can reduce the amount of heat produced by the semiconductor integrated circuit that makes up the display controller.

In the TFT liquid crystal display, an eighth objective of this invention is to provide a technology which allows the user to make internal adjustment and know the setting state of the display.

In the display data conversion method for TFT liquid crystal display, a ninth objective of this invention is to provide a technology which enables display of 100% white or black and also display of linear grey scale.

These and other objectives and novel features of this invention will become apparent from the following description of this specification and the accompanying drawings.

MEANS TO SOLVE THE PROBLEMS

Of the features disclosed in this specification, representative ones may be briefly described in the following.

To achieve the first objective of this invention, a first means of this invention comprises:

a TFT liquid crystal display panel having:

an array of thin-film transistors arranged in a matrix;

a common electrode;

a liquid crystal provided between the array of thin-film transistors and the common electrode;

a plurality of gate signal lines arranged in rows and connected with the gate electrodes of the thin-film transistors in rows; and a plurality of drain signal lines arranged in columns and connected with the drain electrodes of the thin-film transistors in columns;

a gate drive circuit for driving the plurality of gate signal lines of the TFT liquid crystal display panel;

a drain drive circuit for driving the plurality of drain signal lines of the TFT liquid crystal display panel;

a common drive circuit for driving the common electrode;

a power supply circuit;

a display controller for controlling said circuits in response to control signals and display data from a computer unit; and a trapezoidal wave form generation circuit for generating a trapezoidal AC drive voltage from a square wave form AC signal;

wherein the trapezoidal AC drive voltage from the common drive circuit is applied to the common electrode to AC-drive the common electrode.

To achieve the second objective of this invention, a second means of this invention comprises:

a TFT liquid crystal display panel having:

an array of thin-film transistors arranged in a matrix;

a common electrode;

a liquid crystal provided between the array of thin-film transistors and the common electrode;

a plurality of gate signal lines arranged in rows and connected with gate electrodes of the thin-film transistors in rows; and a plurality of drain signal lines arranged in columns and connected with drain electrodes of the thin-film transistors in columns;

a gate drive circuit for driving the plurality of gate signal lines of the TFT liquid crystal display panel;

a drain drive circuit for driving the plurality of drain signal lines of the TFT liquid crystal display panel;

a common drive circuit for driving the common electrode;

a power supply circuit;

a display controller for controlling said circuits in response to control signals and display data from a computer unit; and a level shift circuit which comprises two transistors with their emitters commonly connected together, a base of one transistor applied an input signal and a base of the other transistor applied a reference potential, and a capacitor connected between a collector of the other transistor and a power supply, the level shift circuit being adapted to output the level-shifted input signal from the collector of the other transistor.

To achieve the third objective of this invention, a third means of this invention comprises:

a TFT liquid crystal display panel having:

an array of thin-film transistors arranged in a matrix;

a common electrode;

a liquid crystal provided between the array of thin-film transistors and the common electrode;

a plurality of gate signal lines arranged in rows and connected with gate electrodes of the thin-film transistors in rows; and a plurality of drain signal lines arranged in columns and connected with drain electrodes of the thin-film transistors in columns;

a gate drive circuit for driving the plurality of gate signal lines of the TFT liquid crystal display panel;

a drain drive circuit for driving the plurality of drain signal lines of the TFT liquid crystal display panel;

a common drive circuit for driving the common electrode;

a power supply circuit;

a display controller for controlling said circuits in response to control signals and display data from a computer unit; and a viewing angle adjust means for changing an amplitude of an AC drive voltage applied to the common electrode.

To achieve the fourth objective of this invention, a fourth means of this invention comprises:

a TFT liquid crystal display panel having:

an array of thin-film transistors arranged in a matrix;

a common electrode;

a liquid crystal provided between the array of thin-film transistors and the common electrode;

a plurality of gate signal lines arranged in rows and connected with gate electrodes of the thin-film transistors in rows; and a plurality of drain signal lines arranged in columns and connected with drain electrodes of the thin-film transistors in columns;

a gate drive circuit for driving the plurality of gate signal lines of the TFT liquid crystal display panel;

a drain drive circuit for driving the plurality of drain signal lines of the TFT liquid crystal display panel;

a common drive circuit for driving the common electrode;

a power supply circuit; and a display controller for controlling said circuits in response to control signals and display data from a computer unit;

wherein the drain drive circuit generates intermediate voltages between a plurality of grey-scale reference voltages, and the intermediate voltages and the plurality of grey-scale reference voltages are applied to the drain signal lines to provide multiple grey-scale display;

wherein the grey-scale reference voltage generation circuit generates a plurality of grey-scale reference voltages such that the potential difference between the grey-scale reference voltages in a range of service voltage where an applied voltage-transmission factor characteristic of liquid crystal is non-linear is smaller than the potential difference between the grey-scale reference voltages in a range of service voltage where the applied voltage-transmission factor characteristic is relatively linear;

wherein the number of intermediate voltages generated by the drain drive circuit from the grey-scale reference voltages in the service voltage range where the applied voltage-transmission factor characteristic of liquid crystal is non-linear is smaller than the number of intermediate voltage generated from the grey-scale reference voltages in the service voltage range where the applied voltage-transmission factor characteristic of the liquid crystal is relatively linear.

To achieve the fifth objective of this invention, a fifth means of this invention comprises:

a TFT liquid crystal display panel having:
- an array of thin-film transistors arranged in a matrix;
- a common electrode;
- a liquid crystal provided between the array of thin-film transistors and the common electrode;
- a plurality of gate signal lines arranged in rows and connected with gate electrodes of the thin-film transistors in rows; and
- a plurality of drain signal lines arranged in columns and connected with drain electrodes of the thin-film transistors in columns;

a gate driver board on which a gate drive circuit is mounted for driving the plurality of gate signal lines of the TFT liquid crystal display panel;

a gate driver board on which a drain drive circuit is mounted for driving the plurality of drain signal lines of the TFT liquid crystal display panel;

a power supply board on which a common drive circuit and a power supply circuit are mounted, the common drive circuit driving the common electrode; and an interface board on which a display controller is mounted for controlling said circuits in response to control signals and display data from the computer;

the gate driver board, the drain driver board, the power supply board, and the interface board being arranged outside the TFT liquid crystal display panel;

wherein the drain driver board is installed at only one side of the TFT liquid crystal display panel perpendicular to the side where the gate driver board is installed.

To achieve the fifth embodiment; in a TFT liquid crystal display mounted on the fifth means, the display controller makes the amount of output display data, which is based on the amount of input display data, equal to the amount of input data for the drain driver board.

To achieve the sixth embodiment, in a TFT liquid crystal display (sixth means) mounted on the fifth means, a clock signal to be sent from the display controller to the drain drive circuit is divided into plural equal systems of clock signal and the divided clock signals are each transmitted to the drain drive circuit.

To achieve the seventh objective of this invention, a seventh means (a) of this invention comprises:

a TFT liquid crystal display panel having:
- an array of thin-film transistors arranged in a matrix;
- a common electrode;
- a liquid crystal provided between the array of thin-film transistors and the common electrode;
- a plurality of gate signal lines arranged in rows and connected with gate electrodes of the thin-film transistors in rows; and
- a plurality of drain signal lines arranged in columns and connected with drain electrodes of the thin-film transistors in columns;

a gate drive circuit for driving the plurality of gate signal lines of the TFT liquid crystal display panel;

a drain drive circuit for driving the plurality of drain signal lines of the TFT liquid crystal display panel;

a common drive circuit for driving the common electrode;

a power supply circuit; and a display controller for controlling said circuits in response to control signals and display data from a computer unit;

wherein a buffer circuit is inserted between the display controller and at least one of the gate drive circuit and the drain drive circuit.

To achieve the seventh objective of this invention, a seventh means (b) of this invention comprises:

a TFT liquid crystal display panel having:
- an array of thin-film transistors arranged in a matrix;
- a common electrode;
- a liquid crystal provided between the array of thin-film transistors and the common electrode;
- a plurality of gate signal lines arranged in rows and connected with gate electrodes of the thin-film transistors in rows; and
- a plurality of drain signal lines arranged in columns and connected with drain electrodes of the thin-film transistors in columns;

a gate drive circuit for driving the plurality of gate signal lines of the TFT liquid crystal display panel;

a drain drive circuit for driving the plurality of drain signal lines of the TFT liquid crystal display panel;

a common drive circuit for driving the common electrode;

a power supply circuit; and a display controller for controlling said circuits in response to control signals and display data from a computer unit;

wherein the display controller comprises a plurality of semiconductor integrated circuits.

To achieve the eighth objective of this invention, an eighth means of this invention comprises:

a TFT liquid crystal display panel having:
- an array of thin-film transistors arranged in a matrix;
- a common electrode;
- a liquid crystal provided between the array of thin-film transistors and the common electrode;
- a plurality of gate signal lines arranged in rows and connected with gate electrodes of the thin-film transistors in rows; and
- a plurality of drain signal lines arranged in columns and connected with drain electrodes of the thin-film transistors in columns;

a gate driver board on which a gate drive circuit is mounted for driving the plurality of gate signal lines of the TFT liquid crystal display panel;

a gate driver board on which a drain drive circuit is mounted for driving the plurality of drain signal lines of the TFT liquid crystal display panel;

a power supply board on which a common drive circuit and a power supply circuit are mounted, the common drive circuit driving the common electrode; and an interface board on which a display controller is mounted for controlling said circuits in response to control signals and display data from the computer;

the gate driver board, the drain driver board, the power supply board, and the interface board being arranged outside the TFT liquid crystal display panel;

wherein the interface board has a connector for receiving control signals and display data from the computer, and a part of the connector is connected to a particular location in each drive circuit of the TFT liquid crystal display.

To achieve the ninth objective of this invention, a ninth means of this invention comprises a method of converting n-bit display data from a computer into m-bit ($n<m$) display data for the TFT liquid crystal display, wherein the n bits of display data from the computer correspond to higher-order n bits of display data of the TFT liquid crystal display, and the higher-order ($m-n$) bits of the display data from the computer correspond to the remaining lower-order ($m-n$) bits of display data of the TFT liquid crystal display.

FUNCTION

With the first means, the common electrode is driven by a trapezoidal AC drive voltage, and thus the peak current of the drive transistor can be suppressed, which in turn minimizes the drive circuit of the TFT liquid crystal display, reducing the external size of the display.

With the second means, a capacitor is connected between the positive power supply and the output terminal of the level shift circuit to cancel the noise superimposed on the positive power, and thus it is possible to prevent erroneous operation of the circuit connected behind the level shift circuit, thus improving the noise immunity.

With the third means, the amplitude of the AC drive voltage applied to the common electrode is changed, and thus the viewing angle adjustment on the rFT liquid crystal display can be made with a relatively simple circuit configuration, which in turn simplifies the drive circuit of the TFT liquid crystal display, reducing the external size of the display.

With the fourth means, in the grey-scale reference voltage generation circuit of the TFT liquid crystal display, the number of intermediate voltages to be interpolated between the reference voltages is increased for a region where the applied voltage-transmission factor characteristic of the liquid crystal is relatively linear, and the number of intermediate voltages to be interpolated between the reference voltages is reduced for a region where the applied voltage-transmission factor characteristic of the liquid crystal is non-linear. It is therefore possible to produce a gamma-compensated voltage suited for a particular applied voltage-transmission factor characteristic of the liquid crystal and therefore a good grey-scale display without having to increase the number of externally supplied reference voltages.

With the fifth means, the drain driver is arranged only on one side, upper or lower, of the liquid crystal display panel, and thus the area of the frame edge of the liquid crystal display panel can be reduced, allowing the display area to be increased compared to the external size of the liquid crystal display device.

With the sixth means, the drain driver is installed on either the upper or lower side of the liquid crystal display panel, and a plurality of systems of clock signal are fed to the drain driver. Therefore, the supply of a stable clock signal is assured.

With the 7*a*-th means, the buffer circuit is inserted between the display controller and at least one of the gate drive circuit and drain drive circuit, and thus the power consumption of the semiconductor integrated circuit making up the display controller can be distributed, preventing destruction of the semiconductor integrated circuit.

With the 7*b*-th means, the display controller is constructed of a plurality of semiconductor integrated circuits, and thus the power consumption of the display controller can be distributed, preventing destruction of the semiconductor integrated circuits making up the display controller.

With the eighth means, the connector is provided with a particular terminal, which is connected to a particular location in each drive circuit of the TFT liquid crystal display, and thus it is possible to monitor a variety of signal voltages at that particular location in the drive circuit of the TFT liquid crystal display simply by inserting the connector, making it possible to simplify the adjustment work in the manufacture and final inspection process and thereby reduce the work load.

Simply by inserting the connector, the adjust voltage can be applied from outside to a particular location in each drive circuit of the TFT liquid crystal display, thus allowing the drive circuit of the TFT liquid crystal display module to be tested easily from outside.

With the ninth means, higher-order n bits of the display data for the TFT liquid crystal display use n-bit display data from the computer, and the remaining lower-order (m−n) bits of the TFT liquid crystal display use higher-order (m−n) bits of display data from the computer. It is therefore possible to produce bit strings whose values are thinned out between an all-bit low and an all-bit high.

This allows 100% white or black to be displayed, providing a linear grey-scale display.

BRIEF DESCRIPTION OF THE DRAWINGS

FIG. 16 is a diagram showing the correspondence between the decoder input and the decoder output in FIG. 15.

FIG. 30 is a table showing bit strings converted from four-bit strings into six-bit strings by the digital-to-digital conversion method of FIG. 29.

DESCRIPTION OF THE PREFERRED EMBODIMENTS

Figure 1:
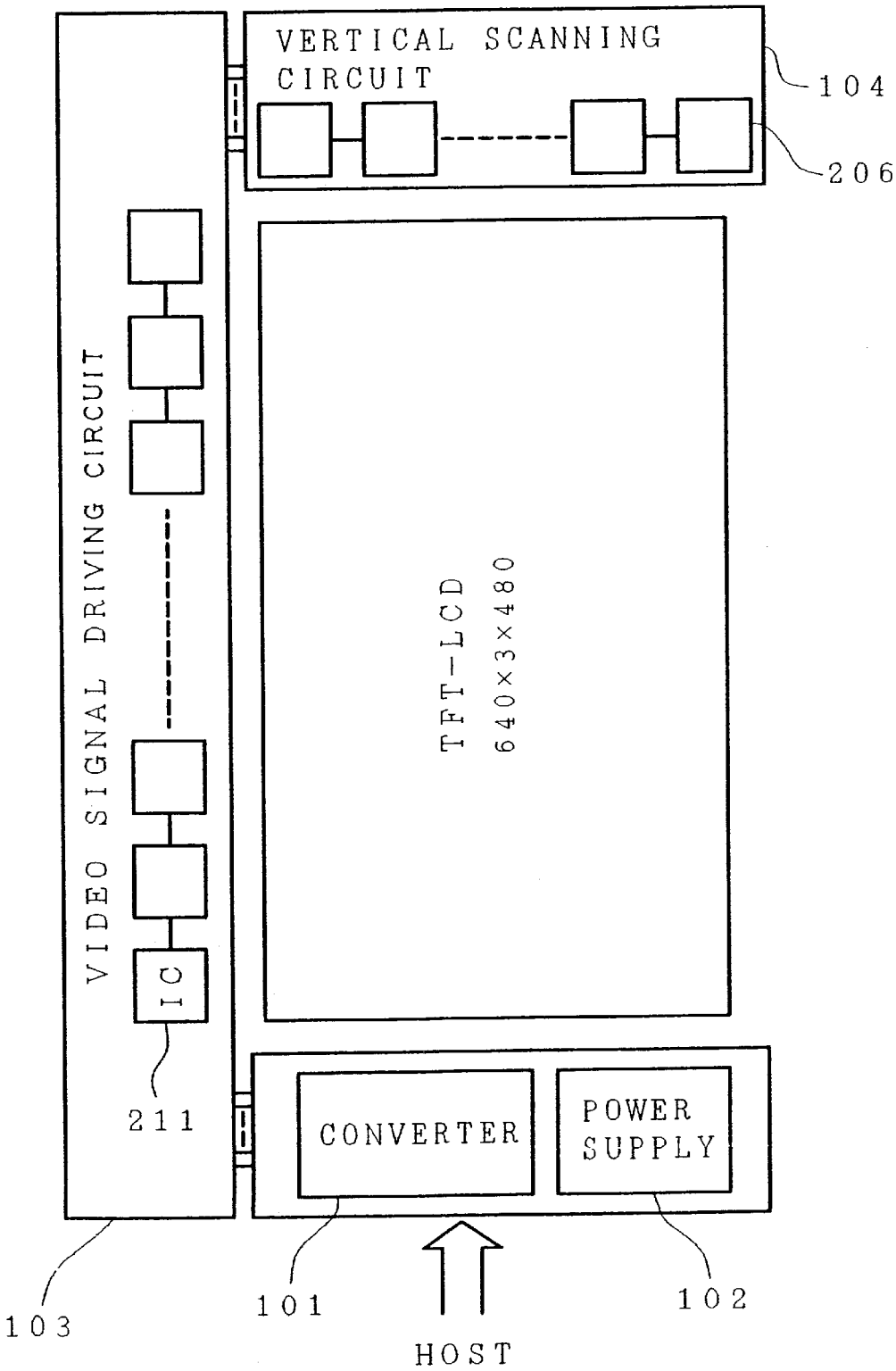
FIG. 1 is a block diagram showing a TFT liquid crystal display panel and its peripheral circuits in the TFT liquid crystal display module as a first embodiment of the liquid crystal display device of this invention.

Referring to the accompanying drawings, embodiments of this invention will be described in detail.

In all the drawings illustrating the embodiments, components having the same functions are assigned like reference numerals and repetition of their explanation is avoided.

FIG. 1 is a block diagram showing a TFT liquid crystal display panel and its peripheral circuits in the TFT liquid crystal display module as the first embodiment of the liquid crystal display device of this invention.

The TFT liquid crystal display module of the first embodiment has a drain driver unit 103 on the upper side of the TFT liquid crystal display panel (TFT-LCD) and also has a gate driver unit (Vertical scanning circuit) 104, a controller unit 101 and a power supply unit 102 on the sides of the TFT liquid crystal display panel (TFT-LCD).

The drain driver unit 103, the gate driver unit 104, the controller unit 101, and the power supply unit 102 are mounted on their dedicated printed circuit boards.

The liquid crystal display panel (TFT-LCD) comprises 640×3×480 pixels.

Figure 2:
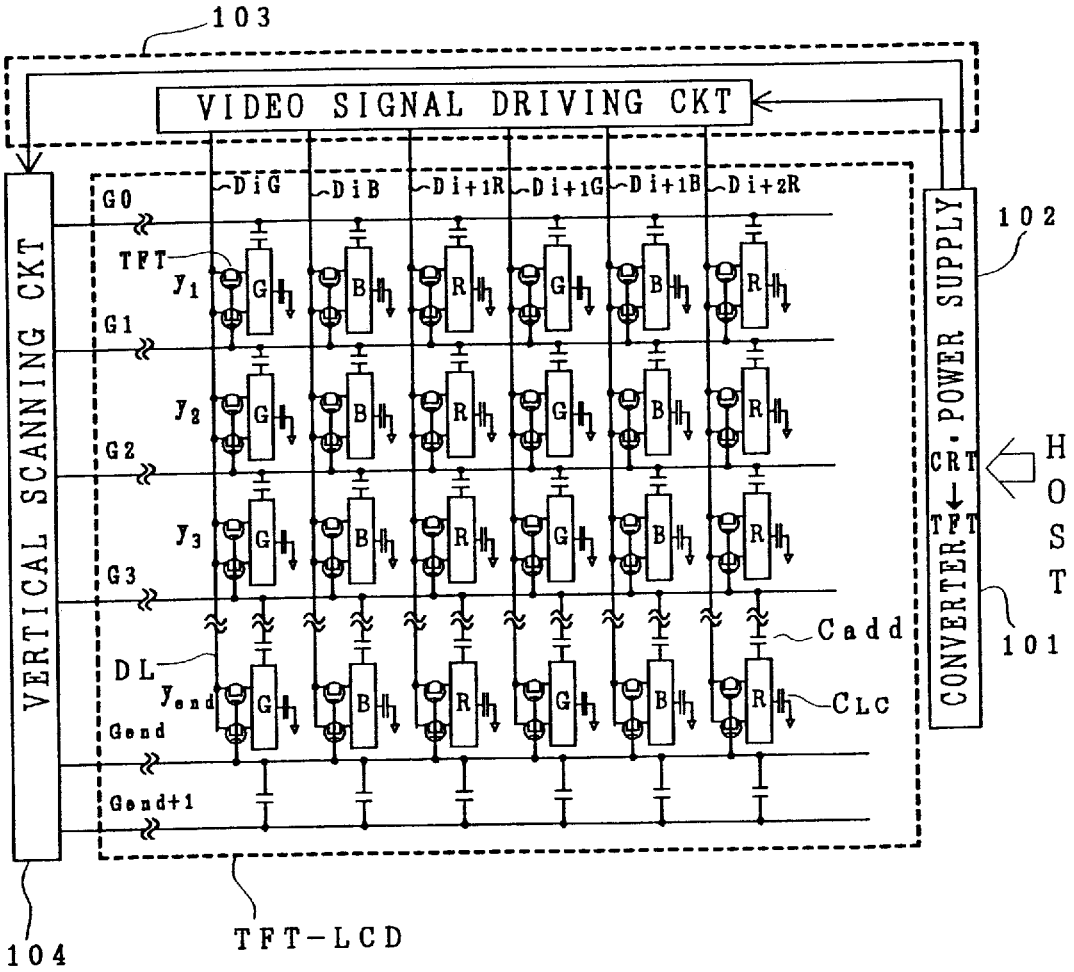
FIG. 2 is an equivalent circuit of the TFT liquid crystal display panel (TFT-LCD) of FIG. 1.

FIG. 2 shows an equivalent circuit of the TFT liquid crystal display panel (TFT-LCD) of FIG. 1.

As shown in FIG. 2, the thin-film transistors TFT are arranged in intersection areas between two adjacent drain signal line (DiG, DiB, . . . ) and two adjacent gate signal lines (G0, G1, . . . ).

The drain electrodes and gate electrodes of the thin-film transistors TFT are connected to the drain signal lines (DiG, DiB, . . . ) and the gate signal lines (G0, G1, . . . ) respectively.

The source electrodes of the thin-film transistors TFT are connected to pixel electrodes and a liquid crystal layer is provided between the pixel electrode and the common electrode, so that a liquid crystal capacitance CLC is equivalently connected between the liquid crystal layer and the source electrode of the thin-film transistor TFT.

The thin-film transistors TFT turn on when a positive bias voltage is applied to its gate electrodes while they turn off when a negative bias voltage applied to them.

A holding capacitance CADD is connected between the source electrode of the thin-film transistor TFT and the previous gate signal line G.

The source electrode and the drain electrode are theoretically determined by the bias polarity between them, so that, their bias polarity in this liquid crystal display device is reversed during operation. It is therefore understood that the source electrode and the drain electrode are switched during operation. In the following description, however, the electrode polarity is fixed for convenience, with one of the electrodes taken to be a source electrode and the other a drain electrode.

In that case, to prevent the other end of the holding capacitance CADD of the first gate line from being open, a dummy gate signal line (G0) is provided outside the gate signal line (G1) to connect the other end of the holding capacitance CADD of the first gate line to the dummy gate line (G0).

Figure 3:
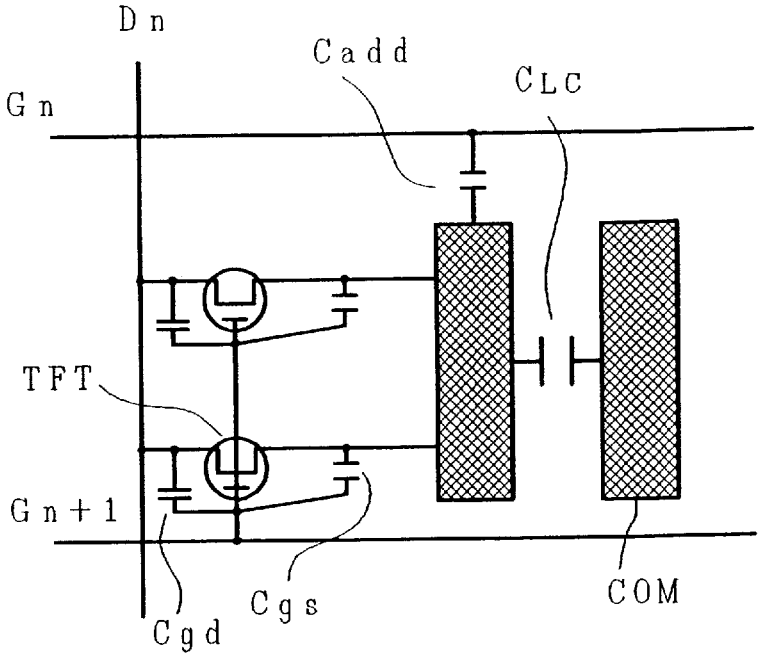
FIG. 3 is an equivalent circuit of one pixel in the TFT liquid crystal display panel (TFT-LCD) of FIG. 1.

In the equivalent circuit of one pixel of the TFT liquid crystal display panel (TFT-LCD) of FIG. 3, there are stray capacitance CGD between drain and gate and stray capacitance CGS between gate and source of the thin-film transistor TFT.

Figure 4:
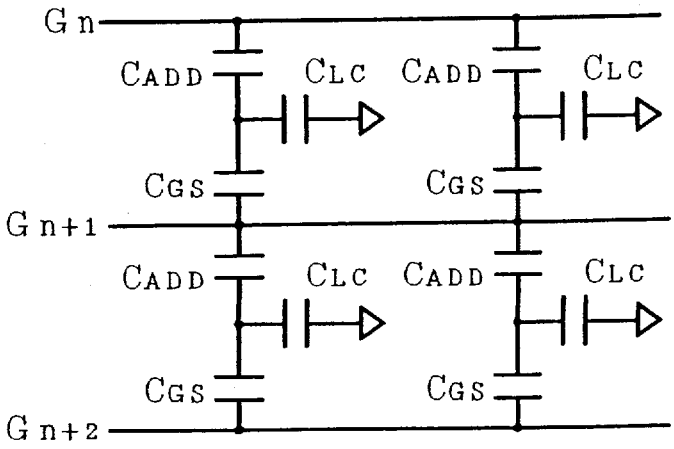
FIG. 4 is a diagram showing capacitances connected to each gate signal line in the equivalent circuit of one pixel in the TFT liquid crystal display panel (TFT-LCD) of FIG. 1.

Hence, as shown in FIG. 4, a series circuit of CADD and CGS is connected between gate signal lines.

There is, however, no gate signal line outside the last gate signal line (Gend), so that the capacitance connected to the gate signal line differs between the last gate signal line (Gend) and other gate signal lines (G1~Gend−1).

In the TFT liquid crystal display module of the first embodiment, therefore, a dummy gate signal line (Gend+1) is provided outside the last gate signal line (Gend) to make the capacitances connected to the gate signal lines almost equal.

The dummy gate signal lines (G0, Gend+1) provided on both sides of the working gate signal lines (G1~Gend) also have the function of preventing electrostatic charges from entering the circuits during the manufacture process.

The holding capacitance CADD, as is well known, has the function of reducing the effects of changes in the gate potential on the pixel electrode potential when the thin-film transistor TFT is switched.

Further, the holding capacitance CADD also prolongs the discharge time, holding the video information long after the thin-film transistor TFT is turned off.

Figure 5:
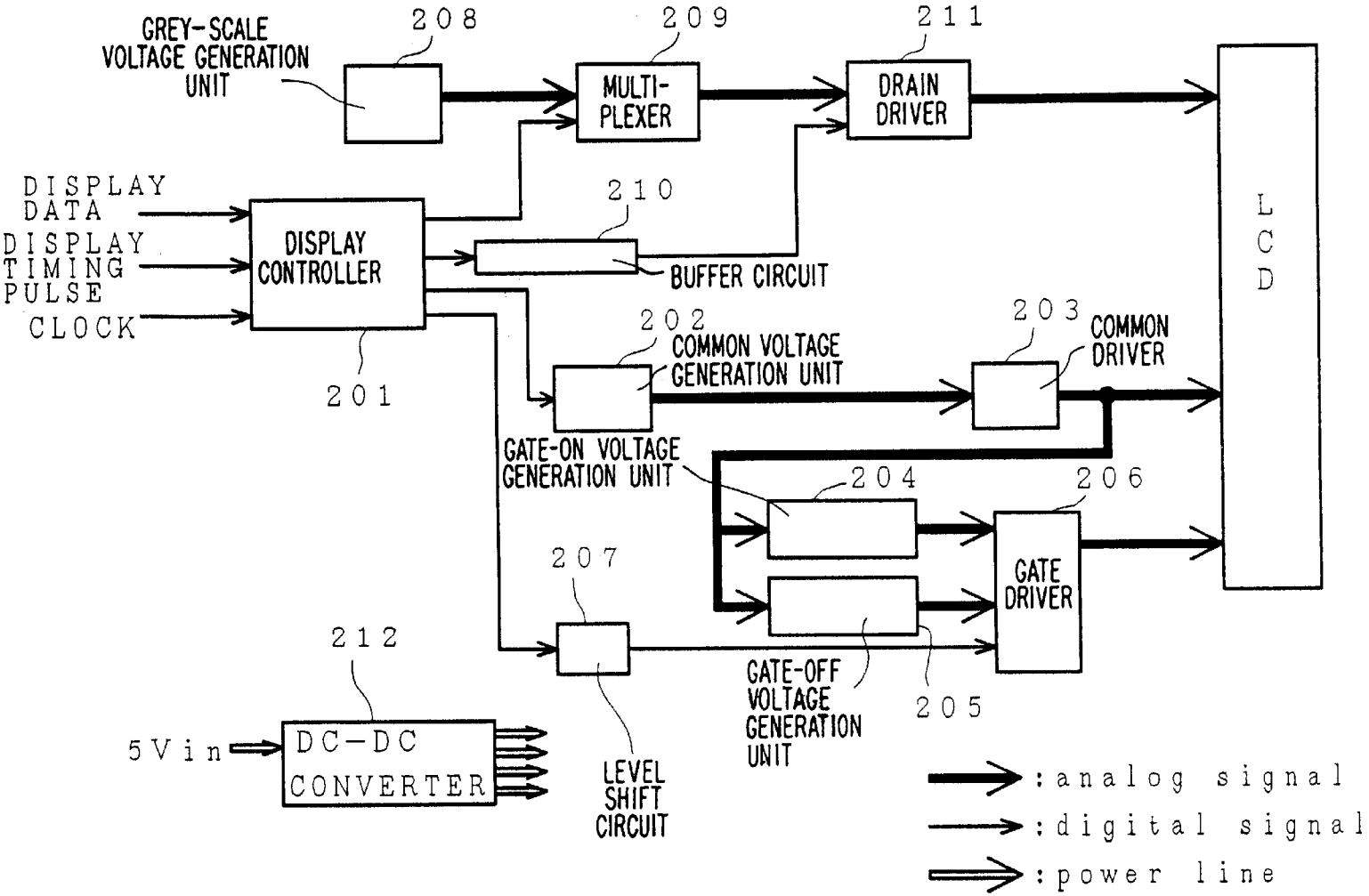
FIG. 5 is a block diagram showing the outline configuration of each driver of the TFT liquid crystal display module of the first embodiment and the flow of signals.

FIG. 5 is a block diagram showing the outline configuration and signal flow of drivers (drain driver, gate driver and common driver) in the TFT liquid crystal display module of the first embodiment.

In FIG. 5, a display controller 201 and a buffer circuit 210 are installed in the controller unit 101 of FIG. 1, a drain driver 211 is provided in the drain driver unit 103 of FIG. 1, and a gate driver 206 is provided in the gate driver unit 104 of FIG. 1.

Figure 40:
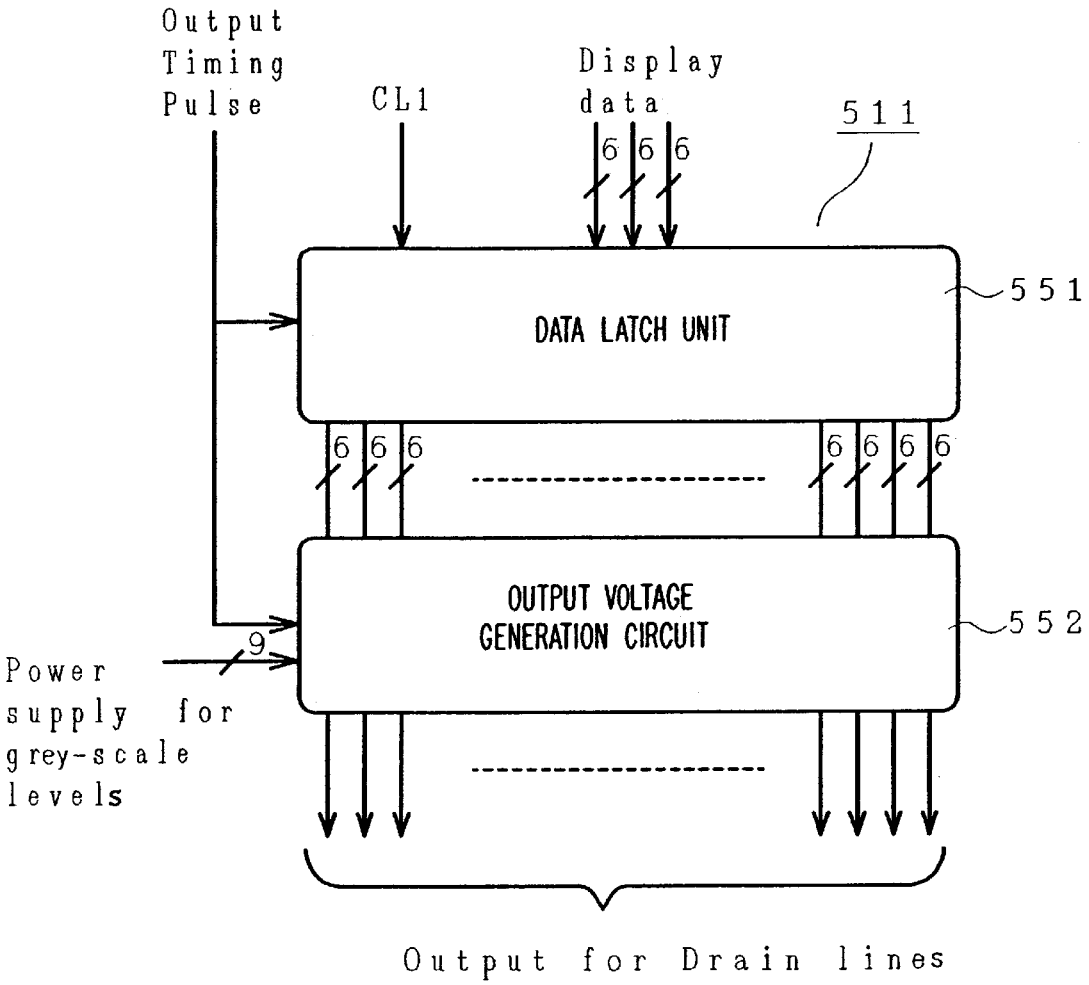
FIG. 40 PRIOR ART
FIG. 40 is a block diagram showing the outline configuration of a drain driver of the conventional TFT liquid crystal display module.
Figure 41:
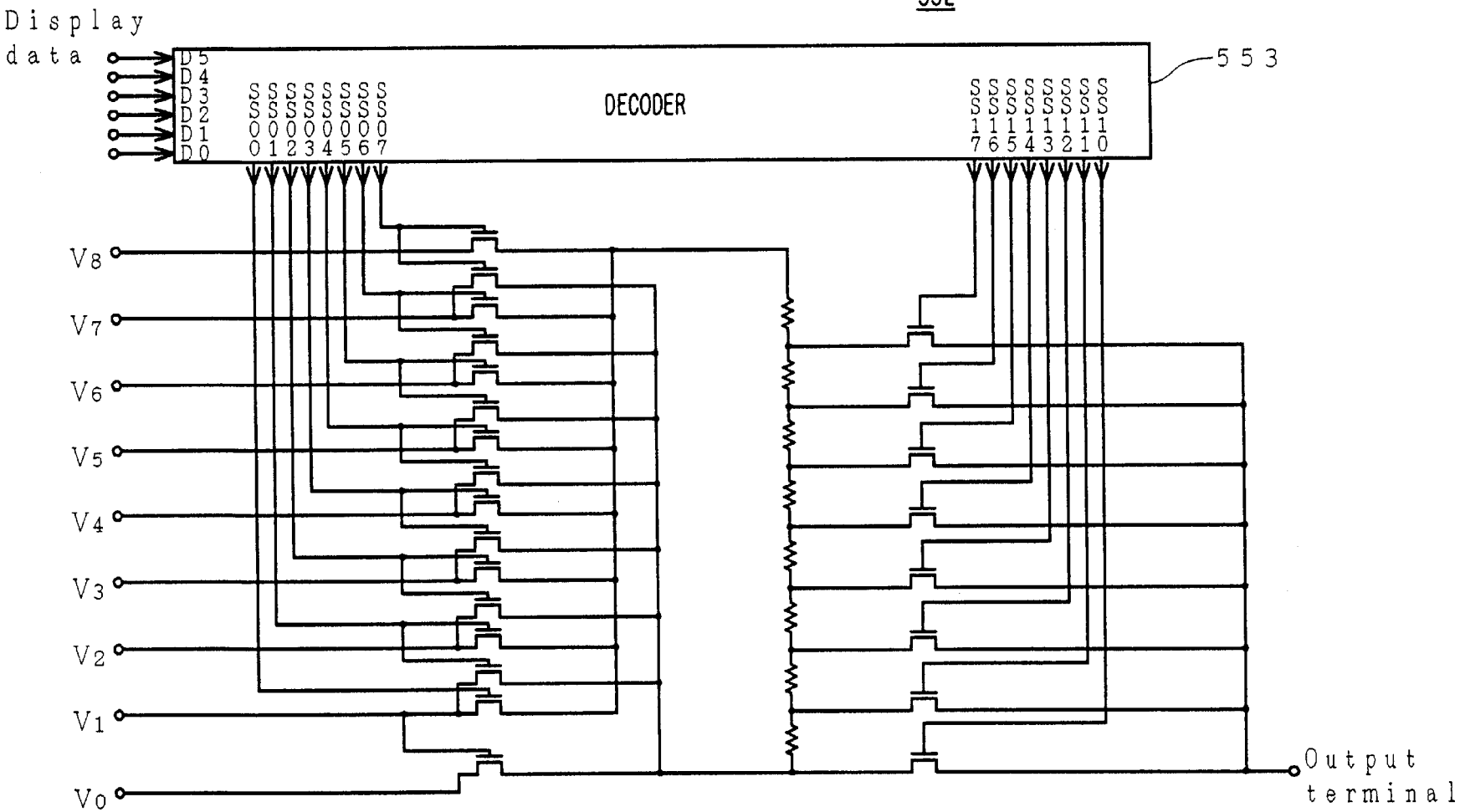
FIG. 41 PRIOR ART
FIG. 41 is a block diagram showing the circuit configuration of an output voltage generation circuit in the drain driver of the conventional TFT liquid crystal display module.
Figure 42:
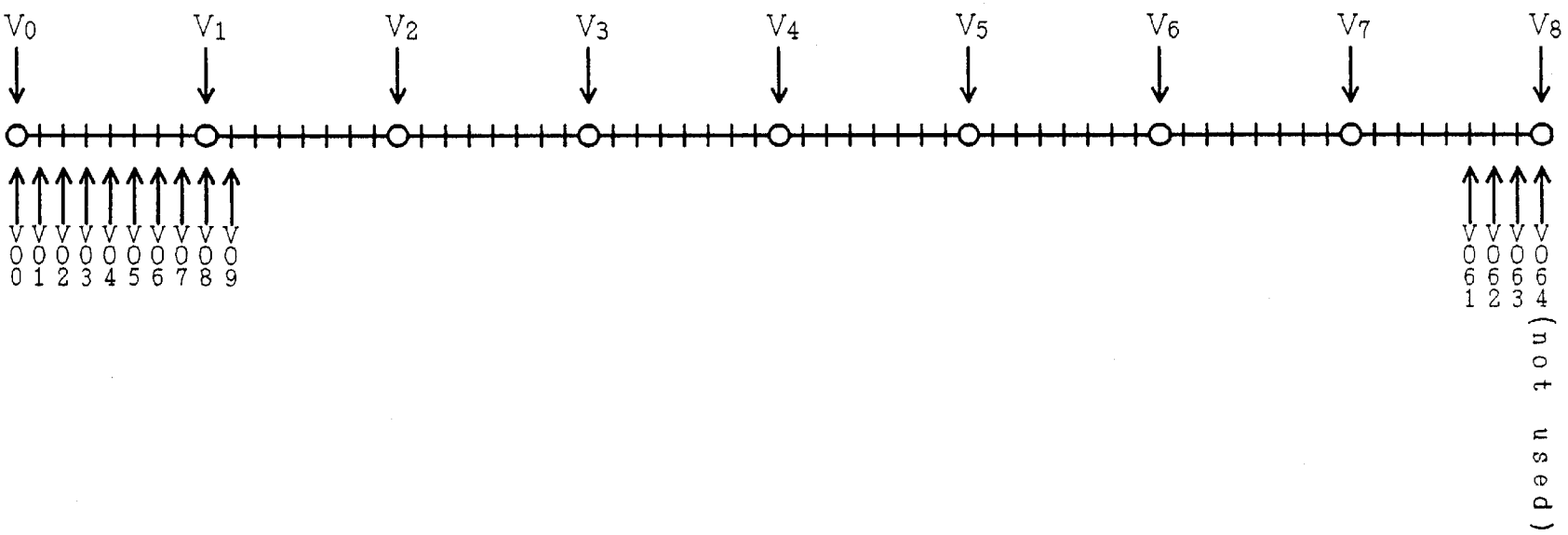
FIG. 42 PRIOR ART
FIG. 42 is a diagram showing the relation between the grey-scale reference voltage and the output voltage in FIG. 41.

The drain driver 211, as the drain driver 511 of FIG. 40 does, comprises a data latch unit for display data and an output voltage generation circuit.

A grey-scale reference voltage generation unit 208, a multiplexer 209, a common voltage generation unit 202, a common driver 203, a level shift circuit 207, a gate-on voltage generation unit 204, a gate-off voltage generation unit 205, and a DC—DC converter 212 are provided in the power supply unit 102 of FIG. 1.

As explained in the description of the prior art, the conventional common electrode AC drive method has a drawback that because a square wave form is used as an AC wave form, a large peak current flows through the common electrode drive transistor when a phase is switched, requiring the transistor to have a large current rating, which in turn increases the size of the drive circuit.

To solve this problem, the TFT liquid crystal display module of the first embodiment transforms a square wave AC signal (M) into a trapezoidal AC signal in the common voltage generation unit 202 of FIG. 5 and applies the trapezoidal AC drive voltage to the common electrode.

Figure 6:
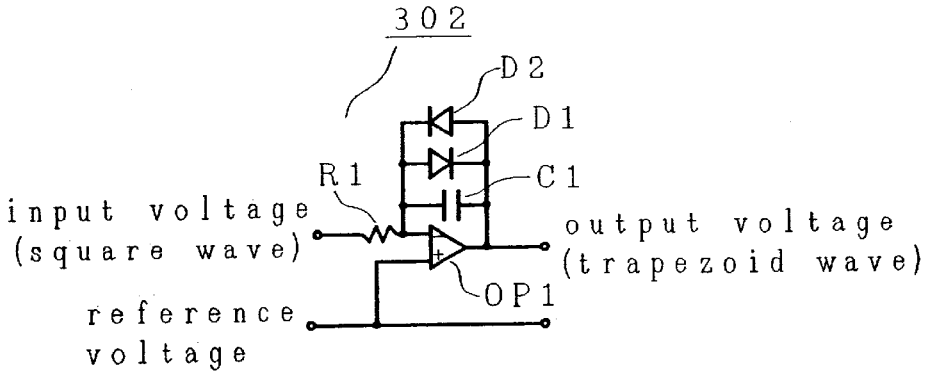
FIG. 6(*a*) is a diagram showing the circuit configuration and FIG. 6(*b*) shows the input/output wave forms of a common voltage generation unit of FIG. 5.
Figure 6:
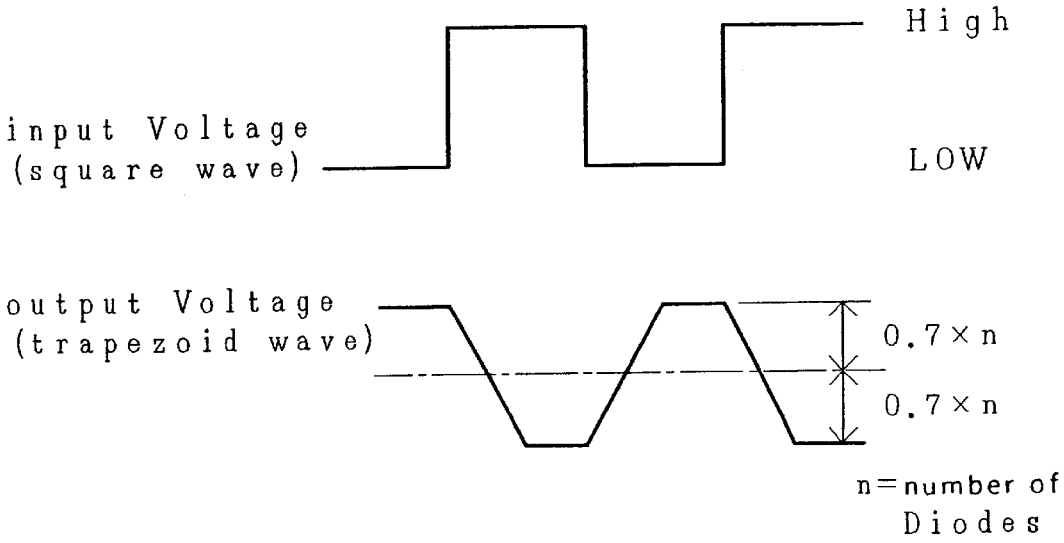

FIG. 6(*a*) shows the circuit configuration and FIG. 6(*b*) shows the input/output wave forms of the common voltage generation unit 202 of FIG. 5.

In a common voltage generation circuit 302 of FIG. 6(*a*), when a high level of square wave form of FIG. 6(*b*) is applied to an AC signal input terminal of operational amplifier OP1, a current flows through a resistor R1 and a capacitor C1. As the capacitor C1 is charged, the output voltage of the operational amplifier OP1 gradually lowers.

When the voltage across the capacitor C1 exceeds the forward voltage of a diode D1 connected in parallel with the capacitor C1, the diode D1 conducts, bringing the output voltage of the operational amplifier OP1 to a fixed low voltage.

When a low level of square wave form of FIG. 6(*b*) is applied to the AC signal input terminal of the operational amplifier, the capacitor C1 is charged through the resistor R1, gradually increasing the output voltage of the operational amplifier OP1.

When the voltage across the capacitor C1 exceeds the forward voltage of a diode D2 connected in parallel with the capacitor C1, the diode D2 conducts, bringing the output voltage of the operational amplifier OP1 to a fixed high voltage.

As a result, a trapezoidal AC signal as shown in FIG. 6(*b*) is obtained at the output terminal of the operational amplifier.

The diode D1 or D2 may be formed by using a plurality of series-connected unit diodes to change the amplitude level of the trapezoidal wave form.

Figure 7:
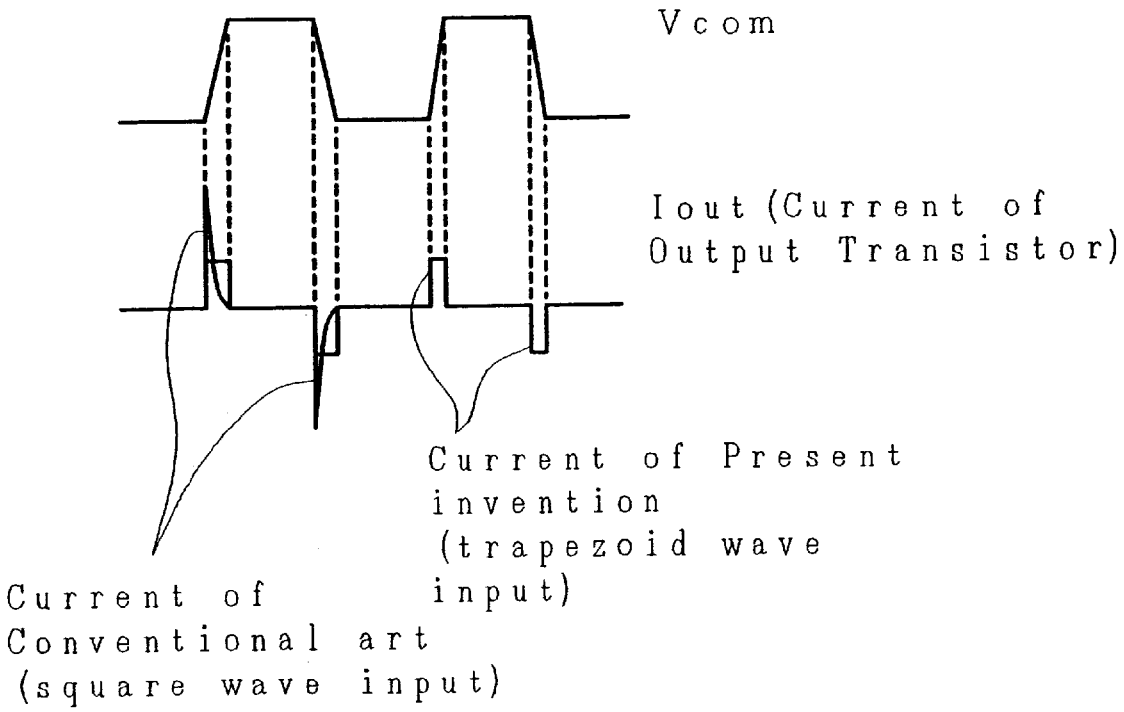
FIG. 7 is a diagram showing that the peak current of the drive transistor can be limited by driving the common electrode with a trapezoidal AC drive voltage.

This trapezoidal AC signal is input into the common driver 203 to drive the common electrode with a trapezoidal AC drive voltage. This puts restriction on the peak current of the drive transistor as shown in FIG. 7, which in turn reduces the size of the drive circuit of the TFT liquid crystal display module and therefore the external size of the TFT liquid crystal display module.

In the equivalent circuit of FIG. 3, the other end of the liquid crystal capacitance CLC is connected to the common electrode COM.

In the TFT liquid crystal display module of the first embodiment, the common electrode is driven by an AC drive wave form. Therefore, the gate signal line of previous stage connected with the other end of the holding capacitance CADD should also be driven by applying an AC drive wave form of the same phase and amplitude as the AC drive wave form applied to the common electrode; otherwise, the potential difference between the ends of the liquid crystal capacitance CLC cannot be kept constant.

Hence, in the TFT liquid crystal display module of the first embodiment, the AC signal from the common driver 203 is, as shown in FIG. 5, fed to the gate-on voltage generation unit 204 and the gate-off voltage generation unit 205 to produce a gate-on voltage and a gate-off voltage, both added with the common electrode AC drive wave form.

Figure 8:
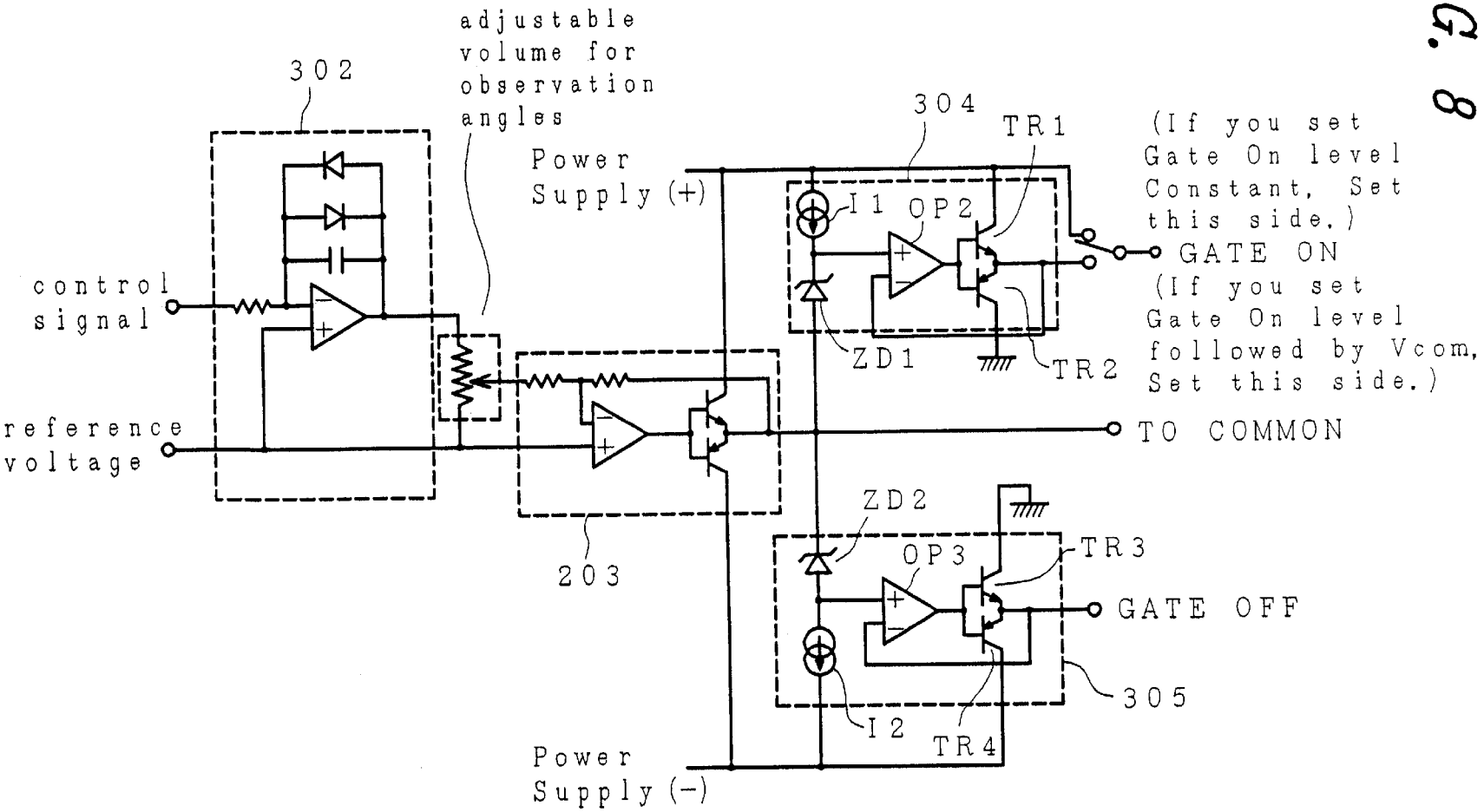
FIG. 8 is a diagram showing the circuit configuration of a gate-on voltage generation unit and a gate-off voltage generation unit.

FIG. 8 shows the circuit configuration of the gate-on voltage generation unit 204 and the gate-off voltage generation unit 205 in the TFT liquid crystal display module of the first embodiment.

In FIG. 8, the gate-on voltage generation circuit 304 comprises a level shift circuit consisting of a constant current source I1 and a Zener diode ZD1, and a buffer circuit consisting of an operational amplifier OP2, an NPN transistor TR1 and a PNP transistor TR2. The gate-on voltage generation circuit 304 shifts the output voltage of the common driver 203 by the level shift circuit and amplifies the shifted voltage by the buffer circuit.

The gate-off voltage generation circuit 305 comprises a level shift circuit consisting of a constant current source I2 and a zener diode ZD2, and a buffer circuit consisting of an operational amplifier OP3, an NPN transistor TR3 and a PNP transistor TR4. The gate-off voltage generation circuit 305 shifts the output voltage of the common driver 203 by the level shift circuit and amplifies the shifted voltage by the buffer circuit.

Figure 9:
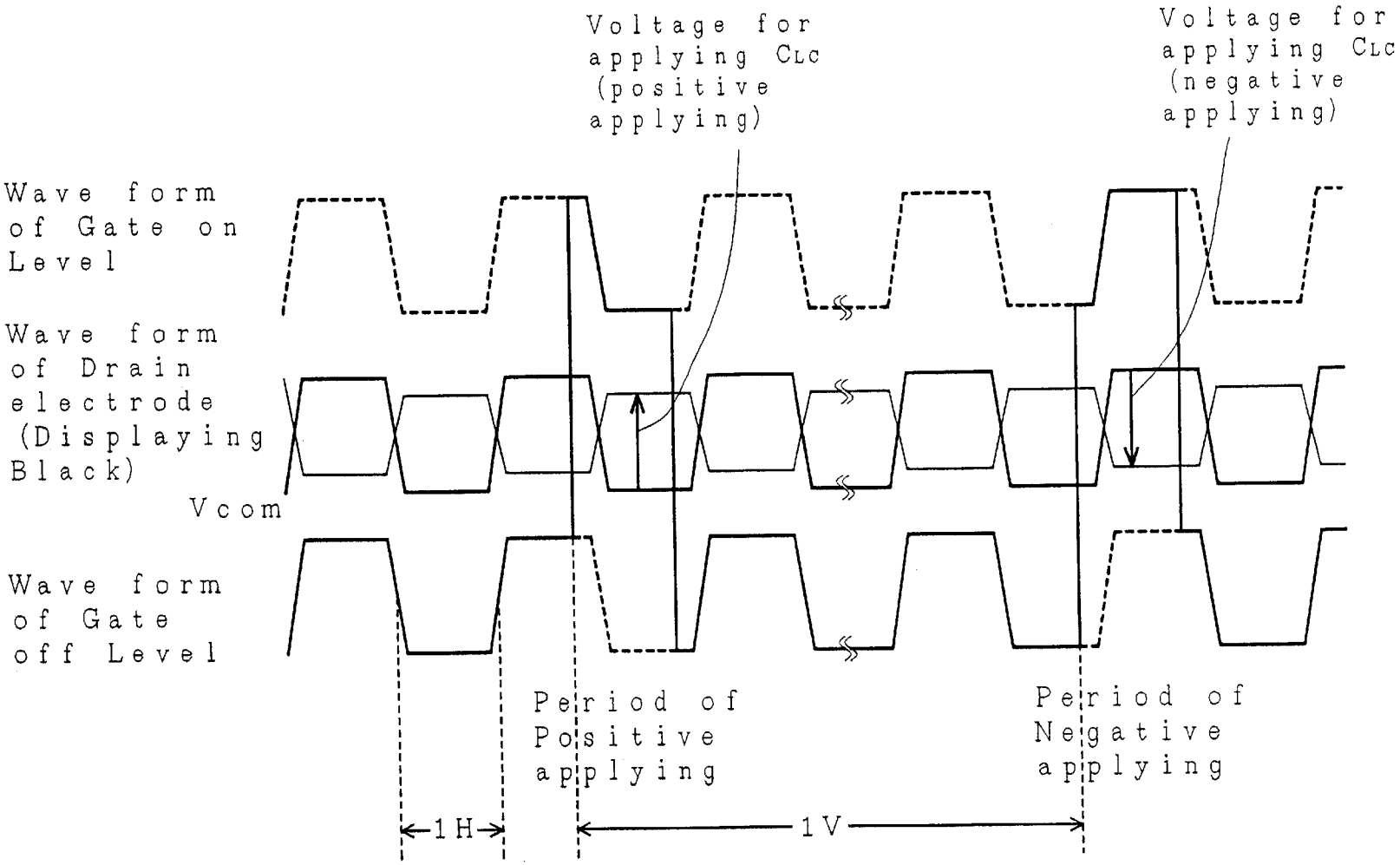
FIG. 9 is a wave form diagram showing voltage levels and wave forms of a common voltage applied to the common electrode, a drain voltage applied to the drain, and a gate voltage applied to the gate electrode.

FIG. 9 shows the voltage levels and wave forms of the common voltage Vcom applied to the common electrode, the drain voltage applied to the drain and the gate on or off level voltage applied to the gate electrode.

In FIG. 9, the drain wave form represents one when black is displayed.

Comparing the common voltage vcom, the gate on level and the gate off level, their wave form shapes are same and, only difference is DC level of them (see FIG. 9).

Therefore, if one of the common voltage Vcom, the gate on level and the gate off level is generated, the others are formed by level shifting.

In the first embodiment, the common voltage Vcom is generated first and, the gate on level and the gate off level are formed by level shifting of the common voltage Vcom.

It is an orthodox way of generating the common voltage Vcom, the gate on level and the gate off level, to feed the output signal from common voltage generation unit 202 into the common driver 203, the gate-on voltage generation unit 204 and the gate-off voltage generation unit 205.

However in the first embodiment, the gate-on voltage generation unit 204 or the gate-off voltage generation unit 205 is composed by the simple circuit. as shown in FIG. 8 and, the mounting density of the TFT liquid crystal display module is improved.

There is another way to of generating the common voltage Vcom, the gate on level and the gate off level that, the gate on level or the gate off level is generated first and, the common voltage Vcom is formed by level shifting of the gate on level or the gate off level.

In the above mentioned way, the common driver 203 is composed by the simple circuit and also, the mounting density of the TFT liquid crystal display module is improved.

Although in the block diagram of FIG. 5 the common electrode AC drive wave form is superposed on both the gate-on voltage and gate-off voltage, because the gate-on voltage can be a DC voltage in driving the thin-film transistor TFT, it is possible to omit the gate-on voltage generation unit 204 in FIG. 5.

Elimination of the gate-on voltage generation unit 204 simplifies the circuit configuration, allowing the TFT liquid crystal display module to be reduced in size.

Figure 10:
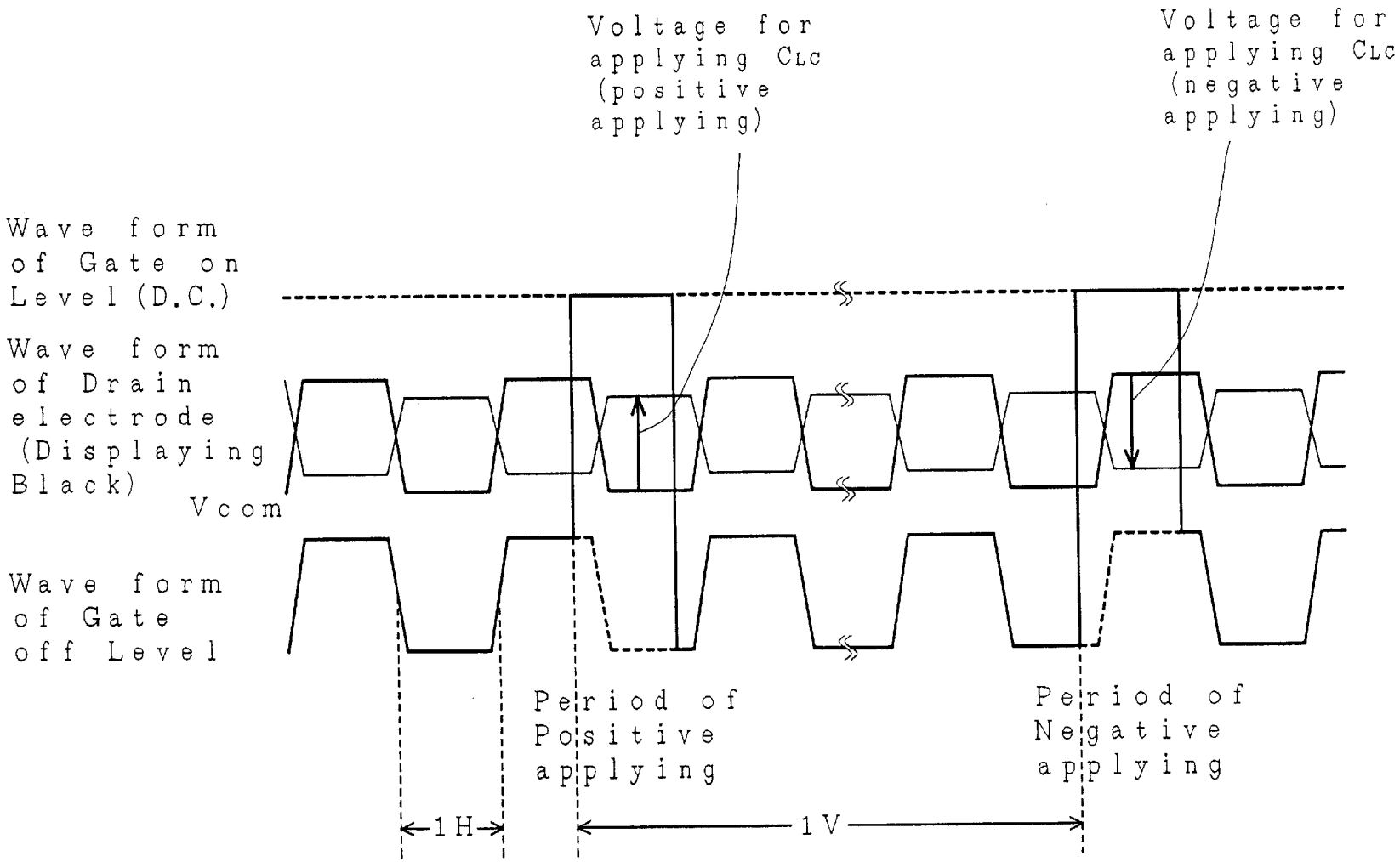
FIG. 10 is a wave form diagram showing voltage levels and wave forms of a common voltage applied to the common electrode, a drain voltage applied to the drain, and a gate voltage applied to the gate electrode when the gate-on voltage generation unit is omitted in the first embodiment.

FIG. 10 shows the voltage levels and wave forms of the common voltage Vcom applied to the common electrode, the drain voltage applied to the drain and the gate on or off level voltage applied to the gate electrode when the gate-on voltage generation unit 204 is eliminated.

As mentioned earlier in FIG. 2, the other end of the holding capacitance CADD of the first gate line is connected to the dummy gate signal line (G0).

By applying the normal gate drive voltage (gate-on voltage, gate-off voltage) to the first dummy gate signal line (G0), it is possible to make the drive condition equal to those of other gate signal lines, thereby improving contrast of pixels of the first line.

Further, by applying the normal gate drive voltage (gate-on voltage, gate-off voltage) also to the last dummy gate signal line (Gend+1), it is possible to make the drive condition equal to those of other gate signal lines, thereby improving contrast of pixels of the last line.

Figure 11:
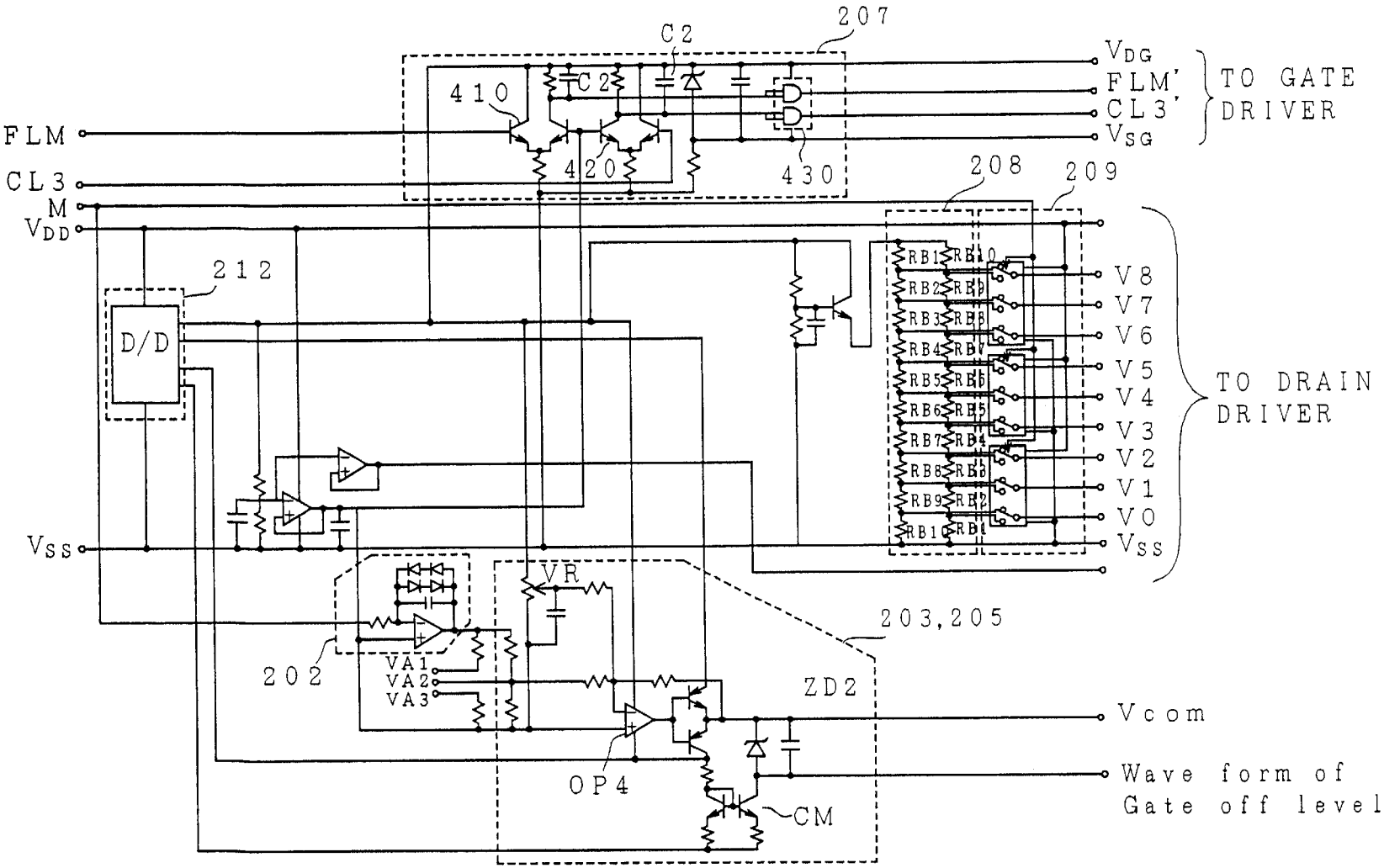
FIG. 11 is a diagram showing the circuit configuration of a power supply unit for the TFT liquid crystal display module as a second embodiment of the liquid crystal display device of this invention.

FIG. 11 shows the circuit configuration of the power supply unit 102 in the TFT liquid crystal display module as a second embodiment of the liquid crystal display device of this invention.

The second embodiment eliminates the gate-on voltage generation unit 204.

FIG. 11 shows enclosed in a dashed line the greyscale reference voltage generation unit 208, multiplexer 209, common voltage generation unit 202, common driver 203, level shift circuit 207, gate-off voltage generation unit 205 and DC—DC converter 212 of FIG. 5.

In FIG. 11, a current mirror circuit CM corresponds to the constant current source I2 of FIG. 8, and the zener diode ZD2 and the current mirror circuit CM together form the level shift circuit.

The output voltage from the common driver 203 is level-shifted by the level shift circuit and taken out as the gate-off voltage.

Further, in FIG. 11, a frame signal (FLM) and a clock signal (CL3) are level-shifted by the level shift circuits (410, 420) and fed to a buffer circuit 430.

Then, the frame signal (FLM') and the clock signal (CL3') output from the buffer circuit 430 are supplied to the gate driver.

If noise is superposed on the positive supply VDG, however, the buffer circuit 430, operating based on the positive supply VDG, malfunctions, resulting in the TFT liquid crystal display module displaying erroneously.

For this reason, in the circuit configuration of FIG. 11, a capacitor C2 is connected between the positive supply VDG and the output of the level shift circuit (FLM' or CL3').

Figure 12:
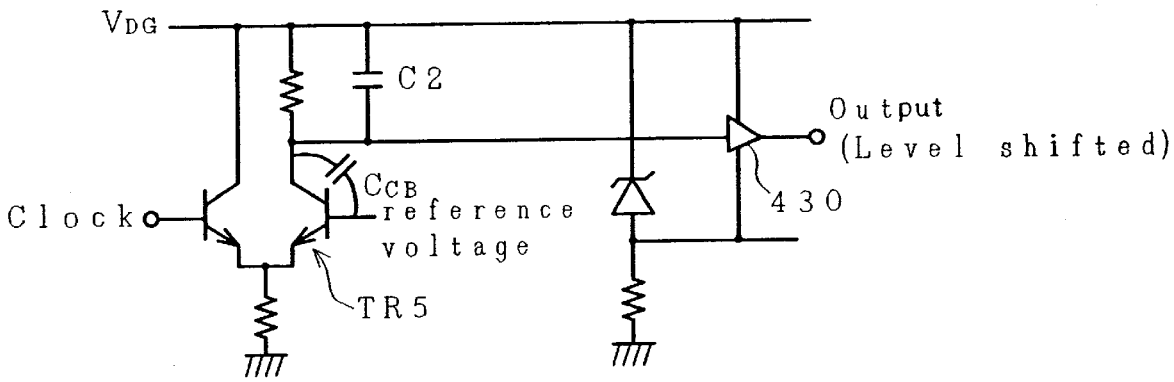
FIGS. 12(*a*)–12(*c*) are diagrams explaining the erroneous operation of a buffer circuit 430 of FIG. 11.
Figure 12:
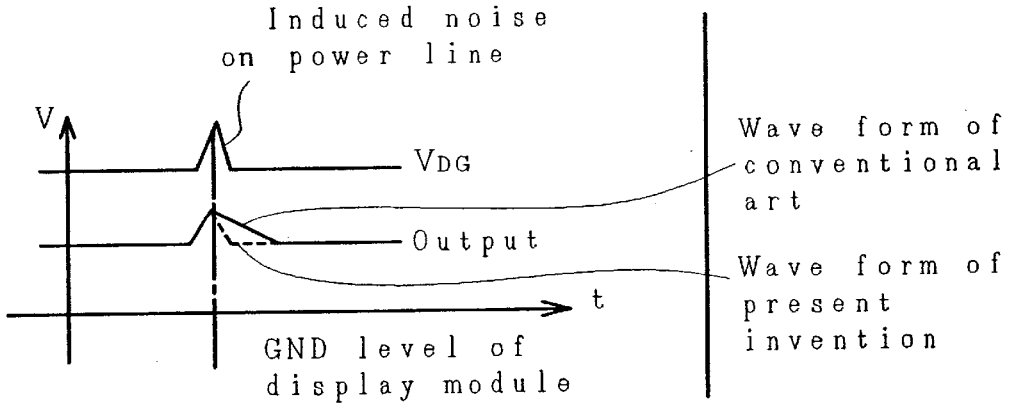
Figure 12:
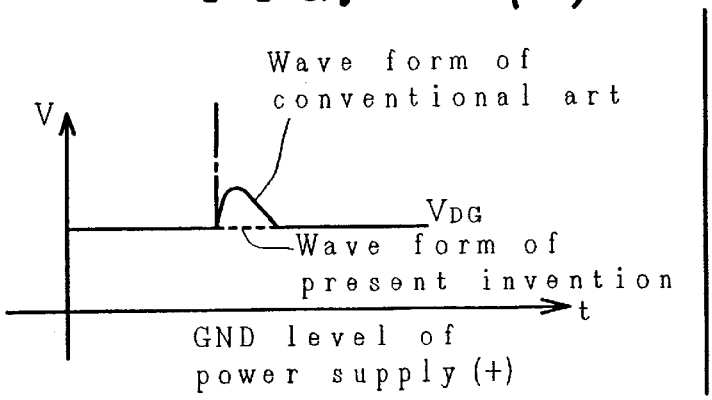

The erroneous operation of the buffer circuit 430 is explained by referring to FIGS. 12(*a*)–12(*c*).

In the TFT liquid crystal display panel, a number of gate lines (G1,G2, . . . ) and drain lines (DiG,DiB . . . ) or common electrodes (COM) are AC-coupled by line stray capacitance or liquid crystal capacitance (CLC), as shown in FIG. 2.

Thus, even in periods when the scan pulse is not input into the gate driver unit 104, other pulses (for example, display signal and common electrode drive pulse) as noise enter the gate driver unit 104 through the line capacitance or liquid crystal capacitance (CLC). The positive power supply VDG of the level shift circuit is also connected to the positive supply of the gate driver unit 104, so that noise generated in the liquid crystal panel is superposed on the positive power supply VDG of the level shift circuit.

In the level shift circuit of the differential amplifier type shown in FIG. 12(*a*), when noise such as shown in FIG. 12(*b*) is induced and if the capacitor C2 is not connected, the noise superposed on the output terminal of the level shift circuit from the positive supply flows through the stray capacitance CCB between collector and base of the transistor TR5 into the ground. Hence, the level shift circuit has the falling edge of the noise in the output voltage vary at a more moderate slope as shown in FIG. 12(*b*).

Hence, considering the output voltage of the level shift circuit with the positive power supply VDG taken as a reference, the potential difference between the positive supply and the output voltage of the level shift circuit at the falling edge of noise decreases as shown in FIG. 12(*c*), producing a pseudo pulse, which in turn causes an erroneous operation of the buffer circuit 430.

That is, when the clock signal (CL3) to the power supply unit of FIG. 11 is low, the pseudo pulse instead of clock signal (CL3) is input to the gate driver, which then performs the shift operation, resulting in an erroneous display.

This embodiment has the capacitor C2 connected between the positive power supply VDG and the output terminal of the level shift circuit. This causes noise of the same wave form as the noise superposed on the positive power supply VDG to pass through the capacitor C2 and become superposed on the output terminal of the level shift circuit, thereby canceling these noise. When considering the output voltage of the level shift circuit with the positive power supply VDG taken as a reference, the potential difference between the positive power supply VDG and the output voltage of the level shift circuit becomes nearly constant as shown by the dashed line of FIG. 12(*b*).

As a result, no pseudo pulse is produced as shown in FIG. 12(*c*), making it possible to prevent erroneous operation of the buffer circuit 430, thus enhancing the noise immunity.

Too large a value of the capacitor C2 will lose the function of the level shift circuit, and too small a value will eliminate the noise canceling effect. The value of the capacitor C2 therefore needs to be set in the range of 20–100 pF.

In the conventional TFT liquid crystal display module, the viewing angle is adjusted by changing the voltage applied to the drain signal line D. It can also be adjusted by changing the voltage applied between the liquid crystal opposing electrode and the pixel electrode. This second embodiment, therefore, changes the voltage applied to the common electrode to adjust the viewing angle.

Figure 13:
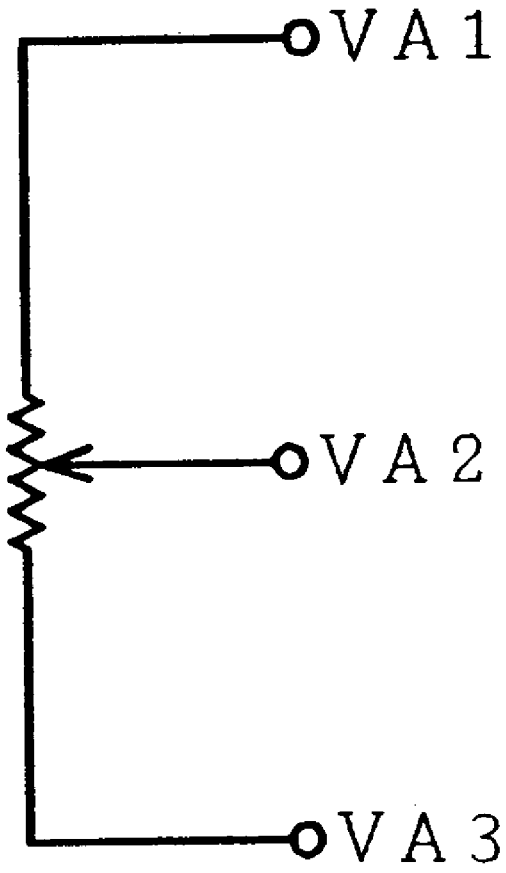
FIG. 13 is a diagram showing a resistor circuit connected to terminals VA1, VA2, VA3 to change the amplitude of the trapezoidal common voltage generated by the common voltage generation unit in the circuit configuration of FIG. 11.

In the circuit configuration of the power supply unit 102 of FIG. 11, a variable resistor such as shown in FIG. 13 is connected to terminals VA1, VA2, VA3 to change the amplitude of the common voltage of the AC drive wave form generated by the common voltage generation unit 202.

This perm its adjustment of the viewing angle of the TFT liquid crystal display module with a relatively simple circuit configuration and also simplifies the drive circuit of the module. This in turn reduces the external dimension of the TFT liquid crystal display module.

Next, in the circuit configuration of FIG. 11, our explanation goes to the grey-scale reference voltage generation unit 208 and the multiplexer 209.

As shown in FIG. 11, the grey-scale reference voltage generation unit 208 comprises two voltage dividing circuits whose outputs are supplied to the multiplexer 209.

The two voltage dividing circuits are constructed in a relationship such that, if one circuit includes series resistors in the sequence of RB1, RB2–RB10, then the other circuit include them in the sequence of RB10, RB9–RB1.

The multiplexer 209 outputs the grey-scale reference voltages (V0~V8) by switching the output from the two voltage dividing circuits in response to the high and low level of the AC s ignal (M).

Suppose that a grey-scale reference voltage of V7 is applied to the drain electrode from the drain driver 211 and that a low-level common voltage Vcom is applied to the common electrode COM from the common driver 203. When the AC signal (M) is inverted, a high-level common voltage Vcom is applied to the common electrode COM from the common driver 203.

In that case, inverted display data is input to the drain driver 211, which applies the grey-scale reference voltage of V1 to the drain electrode.

Figure 43:
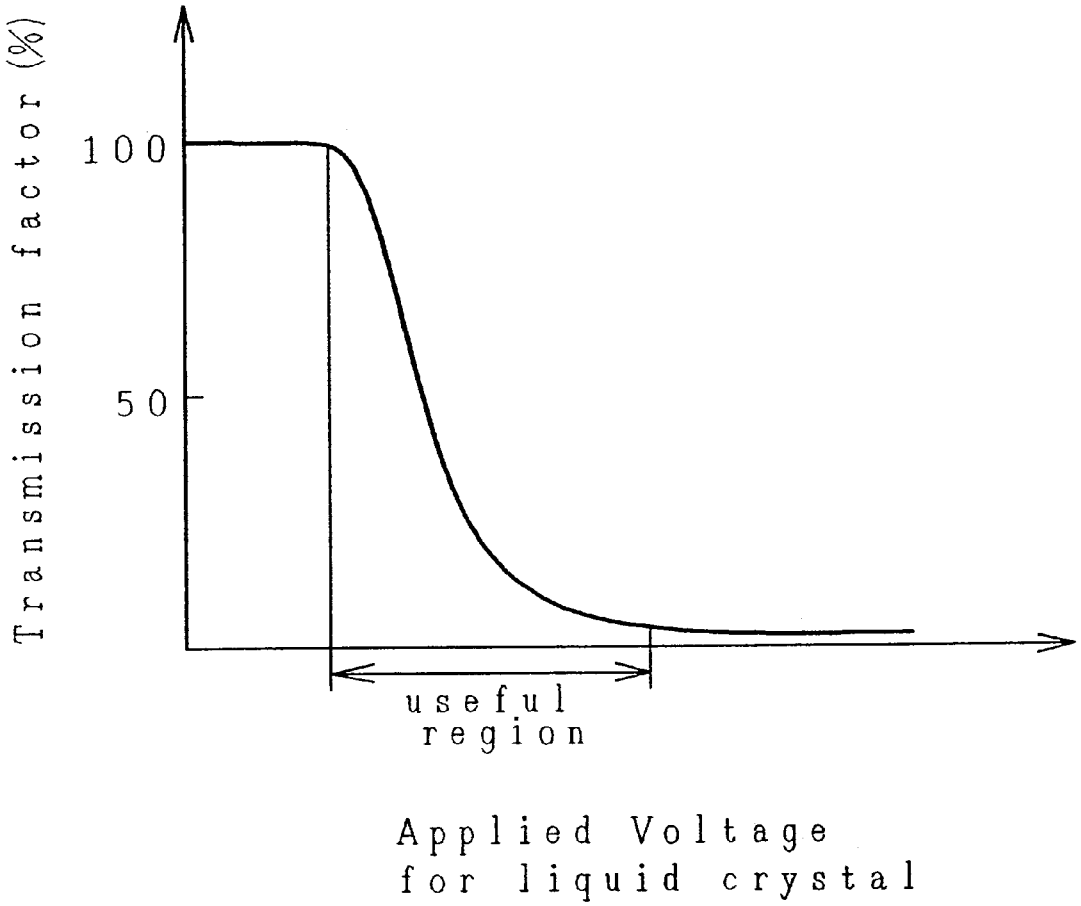
FIG. 43 is a diagram showing a typical, applied voltage-transmission factor characteristic of the liquid crystal.

The reason that the two series circuits of resistors are provided is that the grey-scale reference voltage to be applied to the drain driver 211 must be switched between the inverted and the non-inverted display because of the gamma characteristic of the liquid crystal as shown in FIG. 43.

A trimmer resistor VR is connected to the inverting input terminal of an operational amplifier OP4 of the common driver 203 of FIG. 11 to adjust the DC level of the common signal voltage Vcom.

Next, the TFT liquid crystal display module as a third embodiment of the liquid crystal display device according to this invention is described.

The TFT liquid crystal display module of the third embodiment is constructed to enable good grey-scale display.

Figure 14:
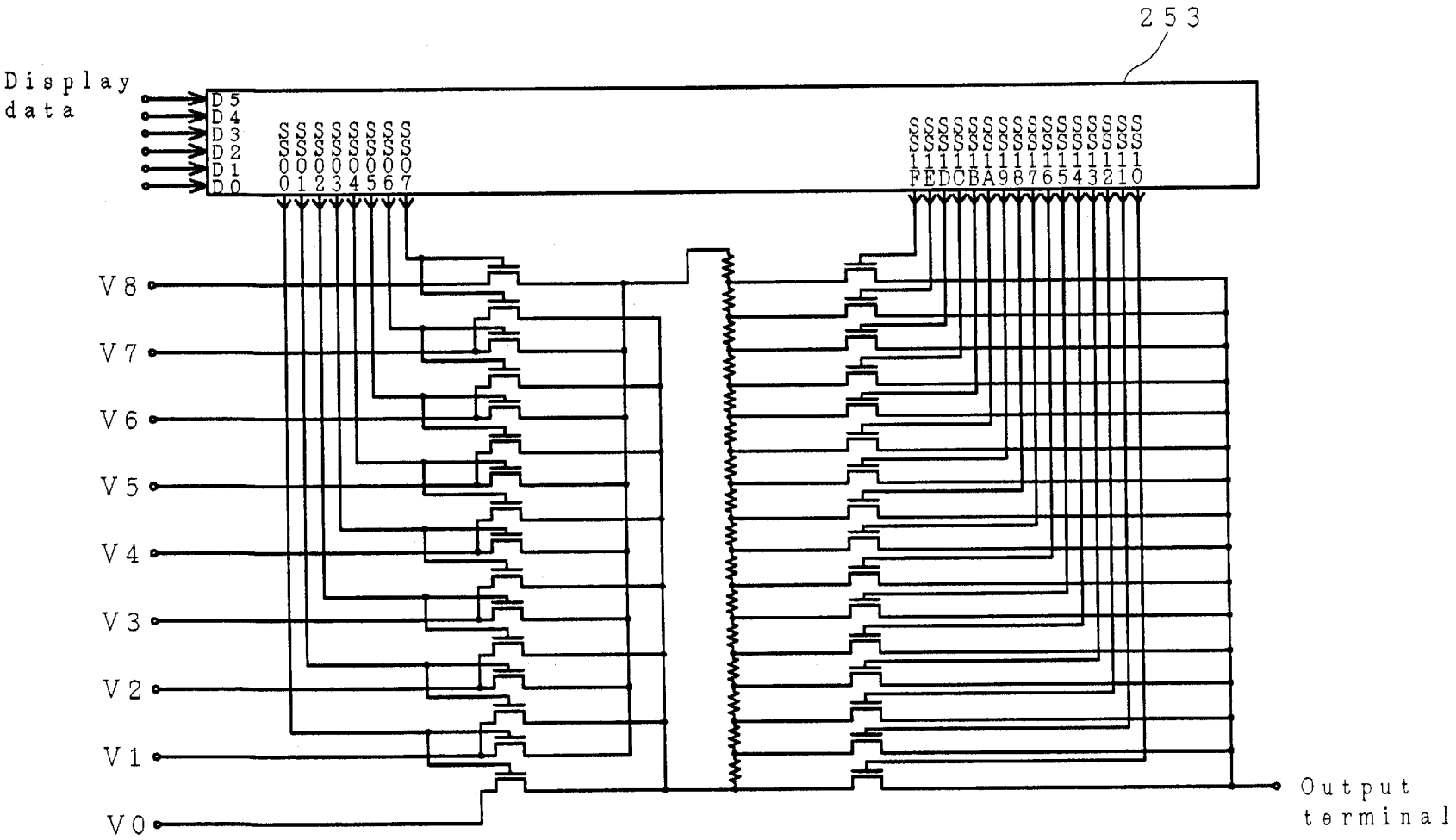
FIG. 14 is a diagram showing the circuit configuration of the output voltage generation circuit of the drain driver of the TFT liquid crystal display module as the third embodiment of this invention.

FIG. 14 shows the circuit configuration of the output voltage generation circuit of the drain driver 211 in the TFT liquid crystal display module of the third embodiment. The figure represents only one of many output voltage generation circuits, which are provided in numbers equal to the total number of the drain signal lines (D).

The drain driver 211 of the TFT liquid crystal display module of the third embodiment is similar in configuration to the drain driver 511 of FIG. 40, and comprises a display data latch unit and an output voltage generation circuit.

The applied voltage-transmission factor characteristic of the liquid crystal generally has a significant non-linearity at the ends of the operating voltage range and is relatively linear at the central portion of the range, as shown in FIG. 43.

The output voltage generation circuit of the drain driver 211 in the TFT liquid crystal display module of the third embodiment, therefore, adopts the following configuration in order to make small the number of voltage values interpolated between each external grey-scale reference voltage at the ends of the operating voltage range and large at the central part. That is, each of the voltage spans between the nine external grey-scale reference voltages (V0~V8) is divided into 16 equal parts and the most appropriate three or seven voltage points are selected from among the 16 voltage divisions by the decoder for the ends of the operating voltage where the voltage transmission factor characteristic of the liquid crystal exhibits non-linearity; and for the central portion of the operating voltage range where the voltage-transmission factor characteristic of the liquid crystal exhibits near-linearity, the 16 voltage divisions are selected by the decoder 253.

Hence, in the output voltage generation circuit of the drain driver in the TFT liquid crystal display module of the third embodiment, the numbers of grey-scale levels interpolated between the grey-scale reference voltages are 3, 3, 7, 15, 15, 7, 3 and 3 in that order.

The third embodiment, like the second embodiment, employs the power supply unit of FIG. 11. The grey-scale reference voltage generation unit 208 produces nine grey-scale reference voltages (V0~V8) such that the potential difference is small between the grey-scale reference voltages (V0–V1, V1–V2, V2–V3, V5–V6, V6–V7, V7–V8) at the ends of the operating voltage range where the voltage-transmission factor characteristic of the liquid crystal is non-linear and that the potential difference is large between the grey-scale reference voltages (V3–V4, V4–V5) at the central part of the operating voltage range where the voltage-transmission factor characteristic of the liquid crystal is relatively linear.

Figure 15:
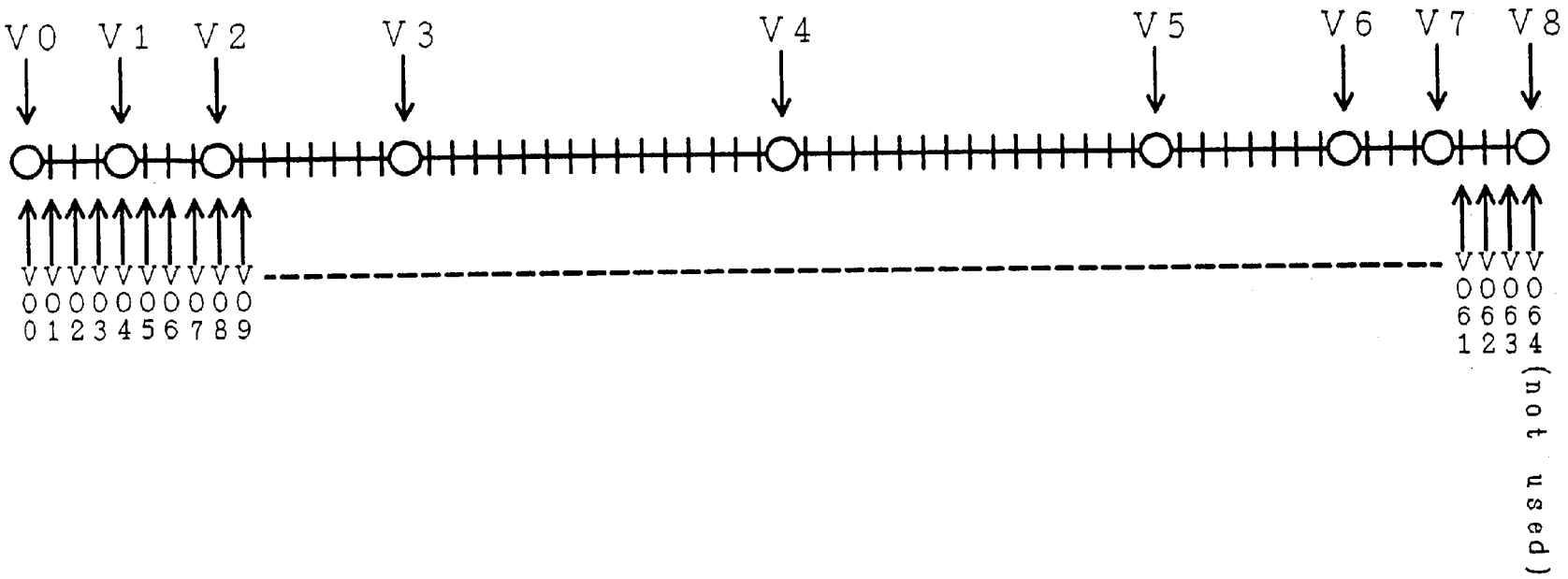
FIG. 15 is a diagram showing the relation between the grey-scale reference voltage and the output voltage in FIG. 14.

FIG. 15 shows the relation between each of the grey-scale reference voltages and the output voltages in FIG. 14.

FIG. 15 shows the total of 65 output voltage values, of which VO64, equal to V8, is not used.

FIG. 16 is a table showing the correspondence between the decoder input and the decoder output in FIG. 15.

As explained above, with the grey-scale reference voltage generation unit 208 and the output voltage generation unit of the drain driver 211 in the TFT liquid crystal display module of the third embodiment, it is possible to increase the number of grey-scale reference voltages that can be set arbitrarily from outside for the ends of the operation voltage range where the applied voltage-transmission factor characteristic of the liquid crystal is significantly non-linear, thereby reducing the deviation between the originally intended grey-scale voltages and those grey-scale voltages generated in the drain driver.

At the central part of the operating voltage range where the applied voltage-transmission factor characteristic of the liquid crystal exhibits linearity, on the other hand, the number of grey-scale reference voltages that can be set arbitrarily from outside is reduced, which in turn increases the number of grey-scale voltages generated by the drain driver 211.

In the central part of the operating voltage range, however, the applied voltage-transmission factor characteristic of the liquid crystal is relatively linear. Therefore, the difference between the desired grey-scale voltages and the grey-scale voltages generated by the drain driver 211 does not become so large as to pose a serious problem.

It is therefore possible to produce a gamma-compensated voltages that match the voltage-brightness characteristic of the liquid crystal and to provide an improved grey-scale display characteristic.

Further, there is no need to increase the number of external grey-scale reference voltage values or peripheral circuits, and accordingly the cost and mounting area do not increase.

In the TFT liquid crystal display module of the first embodiment, the drain driver 211 is arranged only on the upper side of the liquid crystal display panel (TFT-LCD), as shown in FIG. 1.

Figure 17:
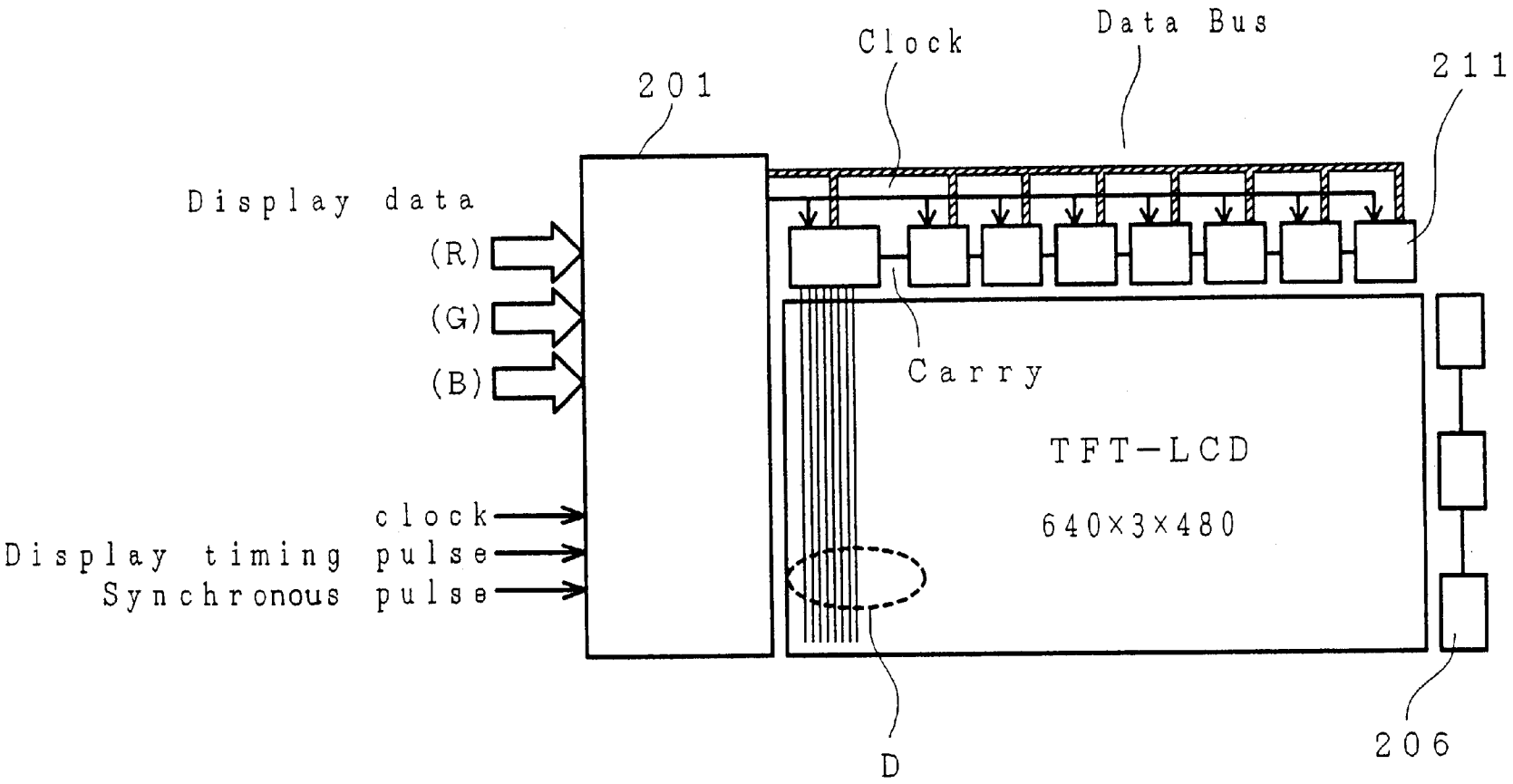
FIG. 17 is a diagram showing the flow of display data and a clock signal for the drain driver in the TFT liquid crystal display module of the first embodiment.

FIG. 17 shows the flow of display data and clock signals for the drain driver 211 in the TFT liquid crystal display module of the first embodiment.

The carry output of a drain driver 211 is connected directly to the carry input of the next drain driver 211.

The carry signal controls the latch operation of the data latch unit 551 of the drain driver 211 to prevent erroneous display data from being written into the data latch unit 551.

The display controller 201 interfaces with the computer and drives the drain driver 211 and the gate driver 206 according to the control signal, clocks, and display data transmitted from the computer.

The display controller 201 of the TFT liquid crystal display module of the first embodiment feeds a single row of display data sent from the computer into the drain driver 211.

Figure 18:
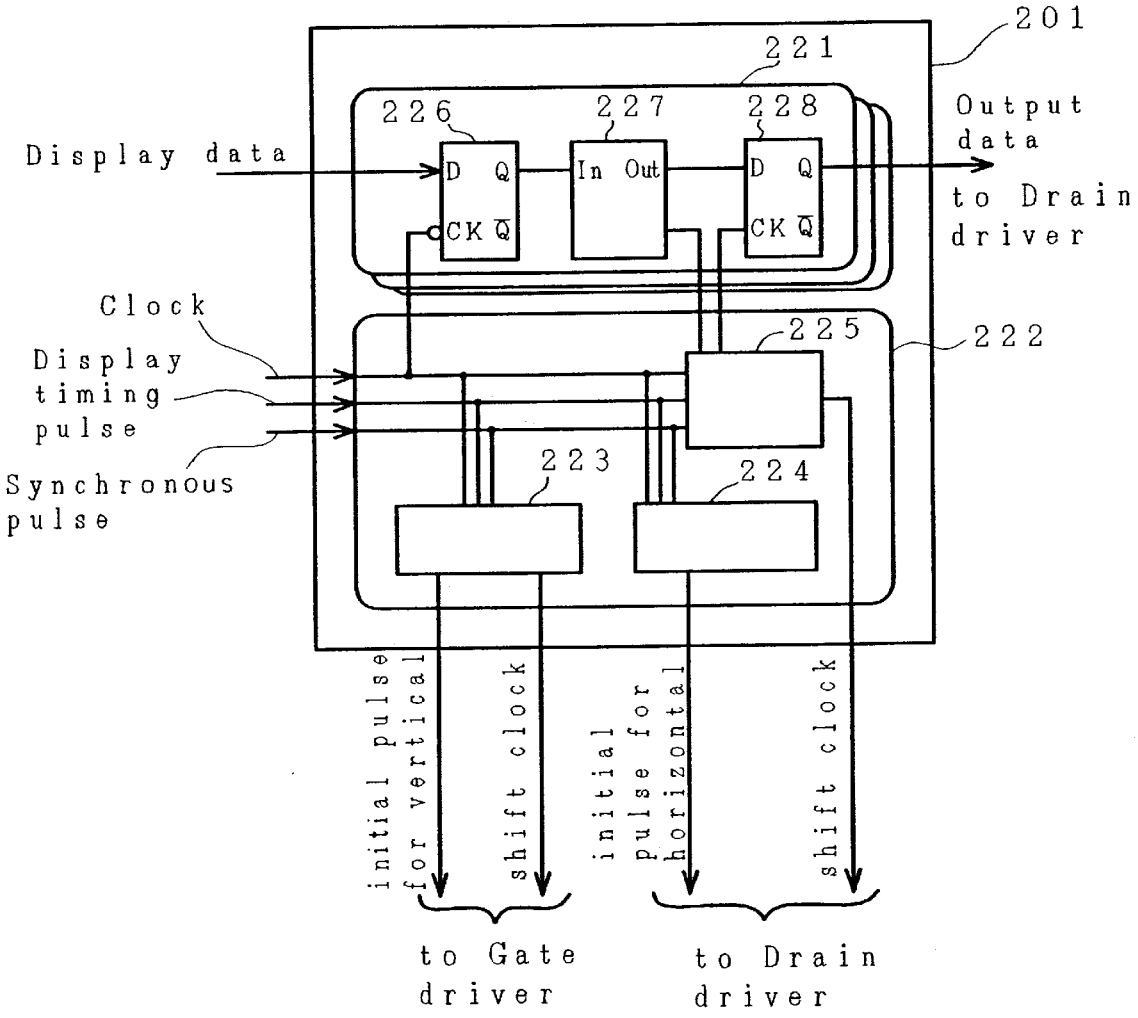
FIG. 18 is a block diagram showing the outline configuration of the display controller of FIG. 17.

FIG. 18 is a block diagram showing the outline configuration of the display controller 201 of FIG. 17.

Figure 19:
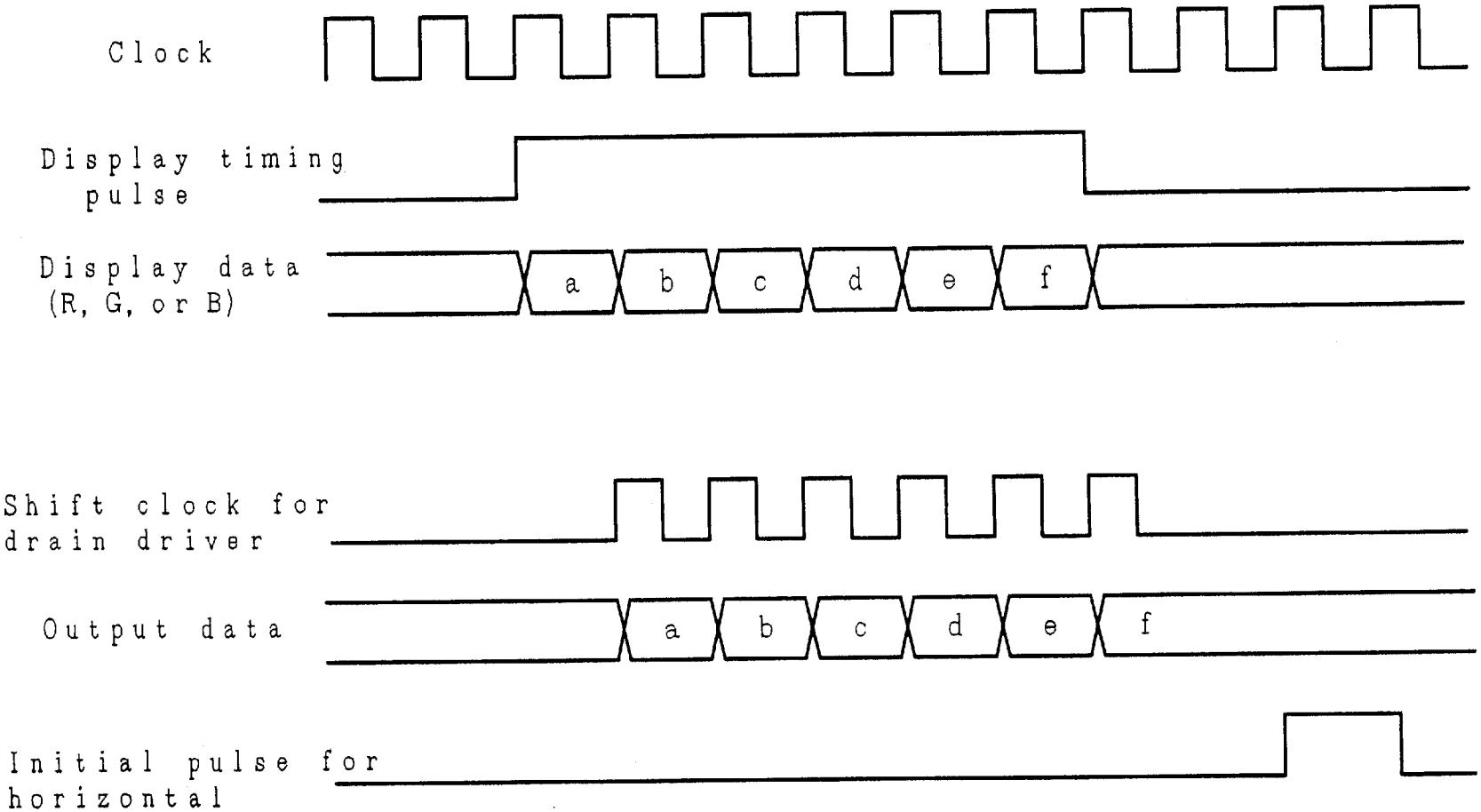
FIG. 19 is a timing chart of the display controller of FIG. 18.

FIG. 19 is a timing chart of the display controller 201 of FIG. 18.

In the TFT liquid crystal display module of the first embodiment, the display controller 201 comprises a data processing unit 221 and a control signal processing/generation unit 222. The control signal processing/generation unit 222 receives control signals (clocks, display timing signal, synchronizing signal) from the computer and generates control signals for the data processing unit 221 and liquid crystal drivers (drain driver 211, gate driver 206).

The control signal processing/generation unit 222 comprises a drain driver drive circuit 224, a gate driver drive circuit 223 and an output clock generation circuit 225. The output clock generation circuit 225 generates a data output clock and a shift clock (CL2) for the drain driver 211.

The data processing unit 221 has a D-type flip-flop 226, a logic processing circuit 227 and a D-type flip-flop 228 connected thereto, and receives display data from the computer and, in response to the clock signal from the control signal processing/generation unit 222, outputs the display data to the drain driver 211.

Figure 20:
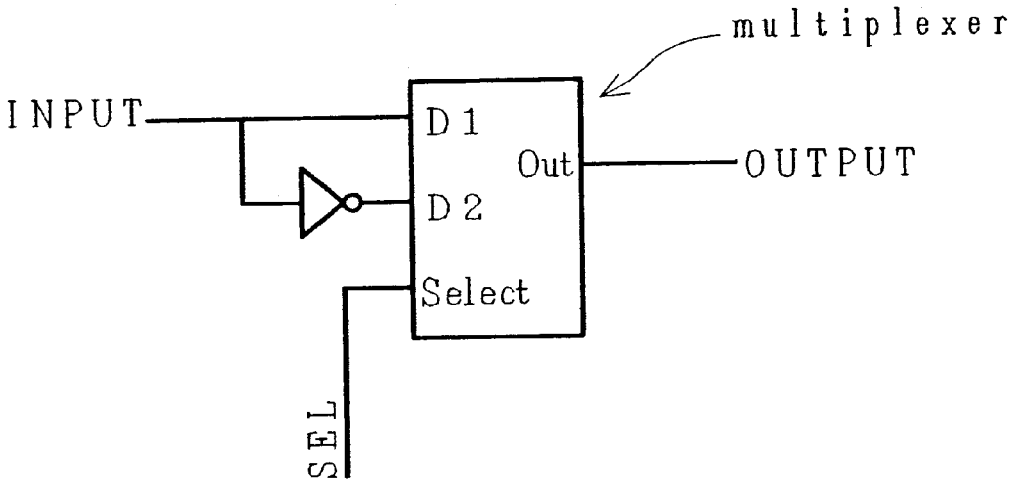
FIG. 20 is a diagram showing the circuit configuration of a logic processing circuit of FIG. 18.

The logic processing circuit 227 of the data processing unit 221 is inserted to invert the display data and it may comprise a multiplexer of FIG. 20.

The logic processing circuit 227 controls the display data inverted or not inverted by the select signal SEL.

If the display data does not need to be inverted, the logic processing circuit 227 is not required.

Necessity of the inverted display data is depends on the specification of drain driver 211.

As is evident from FIG. 19, the shift clock for drain driver and the output data has the same frequency as the clock and the display data fed from the computer. The display data taken into the D-type flip-flop 226 in synchronism with the clock signal of the same frequency as the clock signal from the computer is output onto the data bus from the D-type flip-flop 228 in response to the clock signal, thus putting a single row of display data from the computer on the data bus.

In the TFT liquid crystal display module of the first embodiment, as explained above, the drain driver is installed on either the upper or lower side of the liquid crystal display panel. Therefore, the area of the frame edge of the liquid crystal display panel can be reduced, allowing the display area to be enlarged compared to the external dimension of the liquid crystal display device.

Further, in the TFT liquid crystal display module of the first embodiment, the buffer circuit 210 is inserted between the display controller 201 and the drain driver 211 as shown in FIG. 5.

Figure 21:
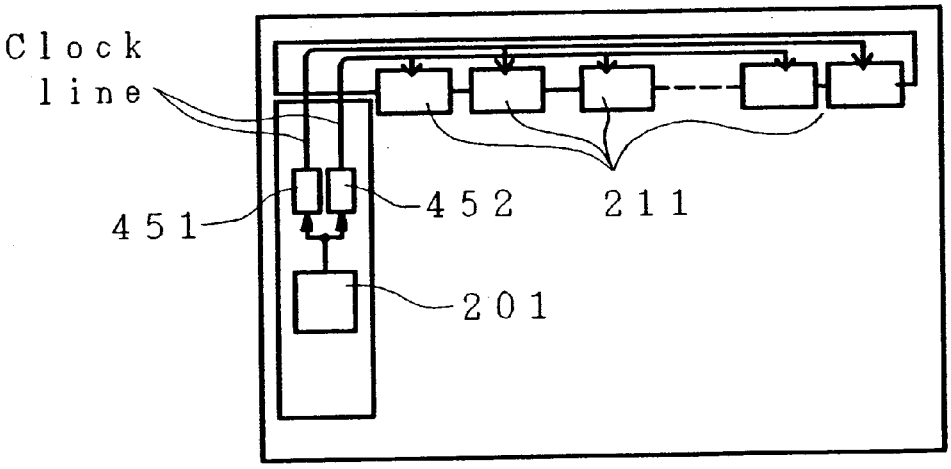
FIG. 21 is a block diagram showing the outline configuration of a buffer circuit of the TFT liquid crystal display module as a fourth embodiment of the liquid crystal display device of this invention.

FIG. 21 is a block diagram showing the outline configuration of the buffer circuit of the TFT liquid crystal display module as a fourth embodiment of the liquid crystal display device according to this invention.

In the first embodiment, all the drain drivers 211 are driven by one system of clock signal from the buffer circuit 210.

In this case, as the number of drain drivers 211 increases, the buffer circuit 210 may become unable to drive the drain drivers 211, that is, a stable clock signal may fail to be supplied.

For this reason, the TFT liquid crystal display module of the fourth embodiment divides the clock signal into two systems, which are supplied from independent buffer circuits (451, 452).

This ensures that stable clock signalLs are supplied even when the number of drain drivers 211 as loads increases.

In the preceding embodiments, the actual liquid crystal drive circuit uses a dedicated LSI or IC.

Figure 22:
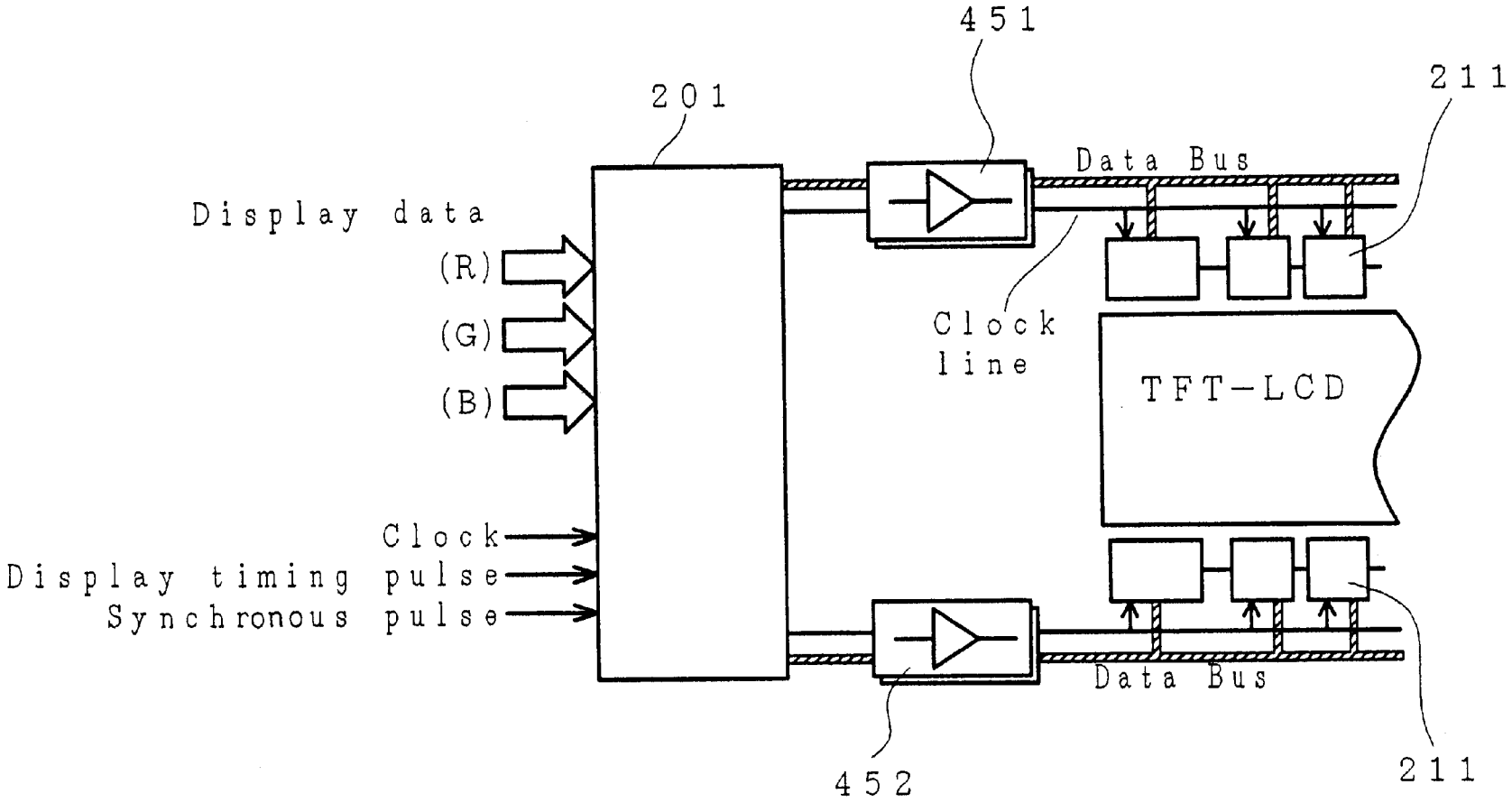
FIG. 22 is a block diagram showing the outline configuration of a display controller of the TFT liquid crystal display module as a fifth embodiment of the liquid crystal display device of this invention.

FIG. 22 is a block diagram showing the outline configuration of the display controller of the TFT liquid crystal display module as a fifth embodiment of the liquid crystal display device according to this invention.

Figure 39:
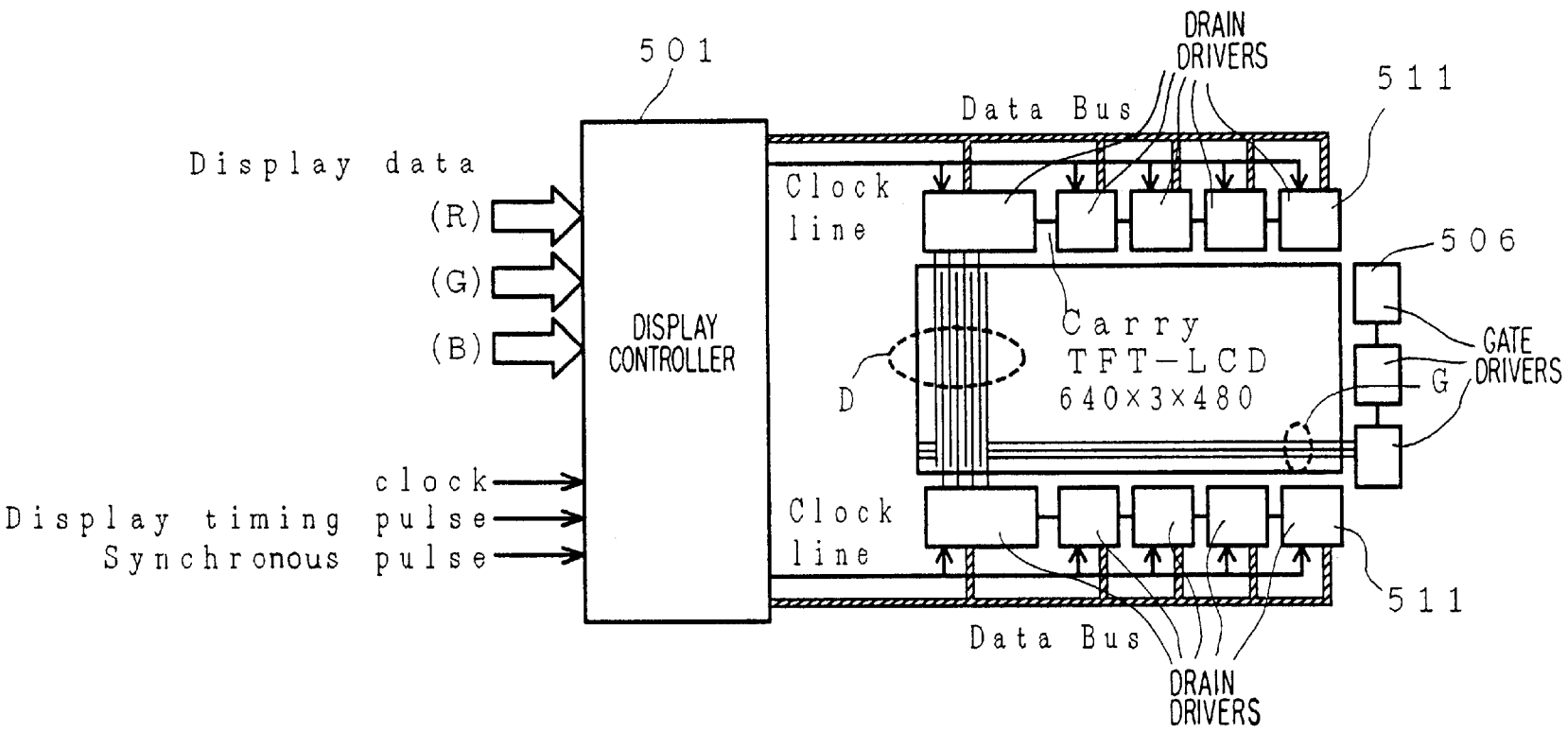
FIG. 39 PRIOR ART
FIG. 39 is a block diagram showing the outline configuration of a conventional TFT liquid crystal display module.

FIG. 22 differs from FIG. 39 in that it includes buffer circuits (451, 452) inserted between the display controller 201 of the TFT liquid crystal display module and the liquid crystal driver (drain driver 211).

The liquid crystal driver (drain driver 211) is therefore driven by the buffer circuits (451, 452), though driven by the display controller 201 in the prior art.

The buffer circuits (451, 452) may be formed of a plurality of semiconductor integrated circuits depending on the number of output terminals to be driven.

This allows the power consumption of the display controller 201, i.e., the resulting heat, to be dispersed into the buffer circuits (451, 452).

Compared with the capacitance of wiring from the display controller 201 to the buffer circuits (451, 452) (about 20 pF), the capacitance of wiring from the buffer circuits (451, 452) to the liquid crystal drivers (drain driver 211, gate driver 206) is large (higher than about 100 pF depending on the number of driver ICs to be connected). Hence, the advantage obtained by dispersing the power consumption of the display controller 201 over the buffer circuits (451, 452) is significant.

While in the above embodiment the buffers 451, 452 are provided between the drain driver 211 and the display controller 201, the buffers may also be installed between the gate driver 206 (not shown) and the display controller 201. This is also effective for limiting the heating of the display controller 201.

For mounting on a printed circuit board, it is preferred that the display controller 201 and the buffer circuits (451, 452) be installed as close to each other as possible to reduce the wiring capacitance and therefore limit the power consumption of the display controller 201.

In the TFT liquid crystal display module of the fifth embodiment, the buffer circuits (451, 452) need not be developed as a custom-made semiconductor integrated circuit but can be implemented by a standard semiconductor integrated circuit.

The TFT liquid crystal display module of the fifth embodiment uses a non-inverting circuit element in the buffer circuits (451, 452). Depending on the circuit configuration, it is possible to use an inverting circuit element (inverter) or a flip-flop circuit.

In the TFT liquid crystal display module of the fifth embodiment, however, the addition of the buffer circuits (451, 452) results in an increased total area of the mounted semiconductor integrated circuit and an increase in the overall power consumption to such an extent as is required by the driving of the buffer circuits (451, 452) from the display controller 201.

In the driving of the drain driver 211, the display controller 201 has a greater number of output lines of the display data bus than the number of control signals.

As the number of grey-scale levels increases, so does the number of output lines of data from the display controller 201.

The display controller 201 can be divided into the data processing unit 221 and the control signal processing/generation unit 222 to reduce power consumption.

Figure 23:
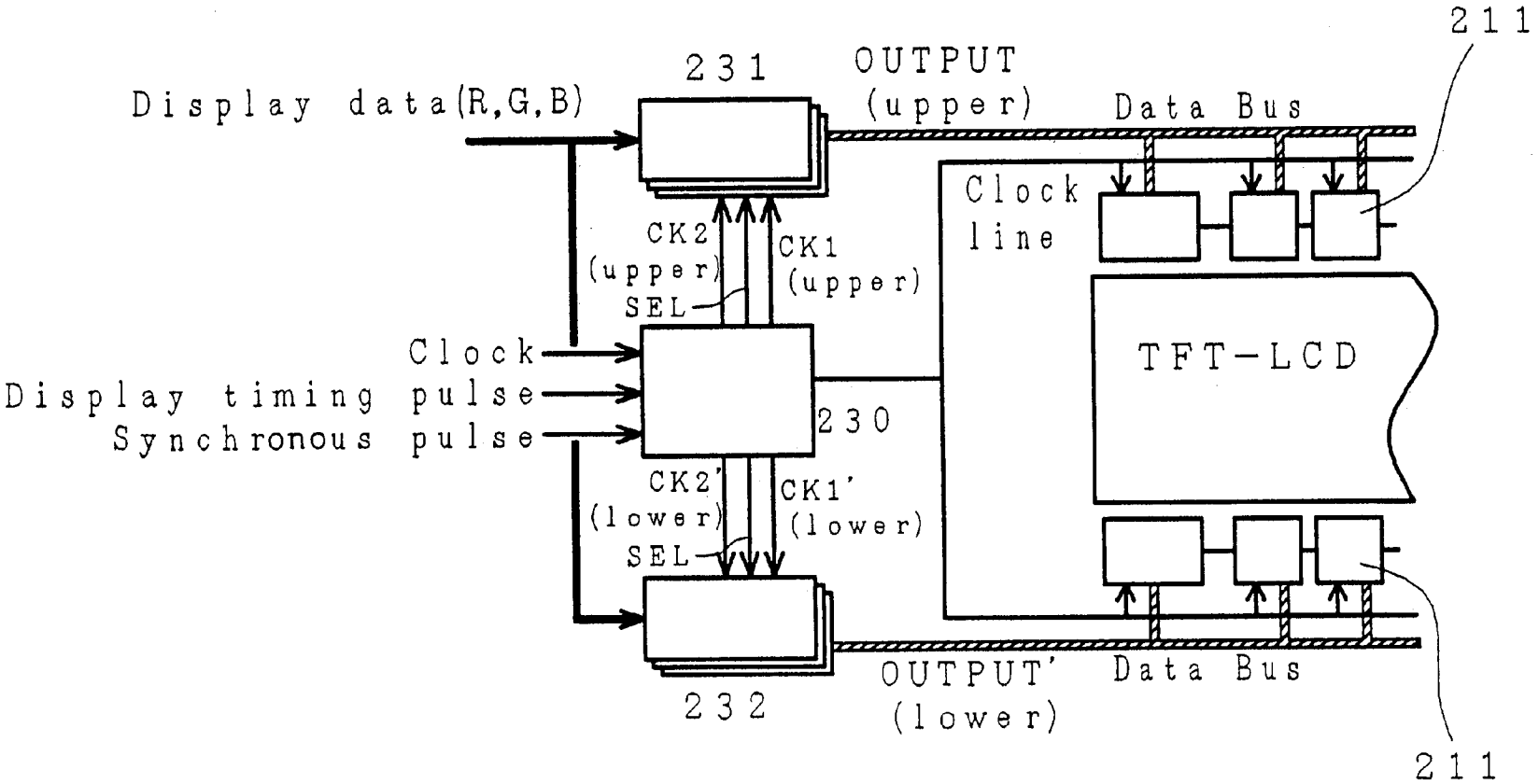
FIG. 23 is a block diagram showing the outline configuration of a display controller of the TFT liquid crystal display module as a sixth embodiment of the liquid crystal display device of this invention.

FIG. 23 is a block diagram showing the outline configuration of the display controller of the TFT liquid crystal display module as a sixth embodiment of the liquid crystal display device according to this invention.

In the sixth embodiment the display controller 201 is divided into a data processing unit 221 and a control signal processing/generation unit 222.

Figure 24:
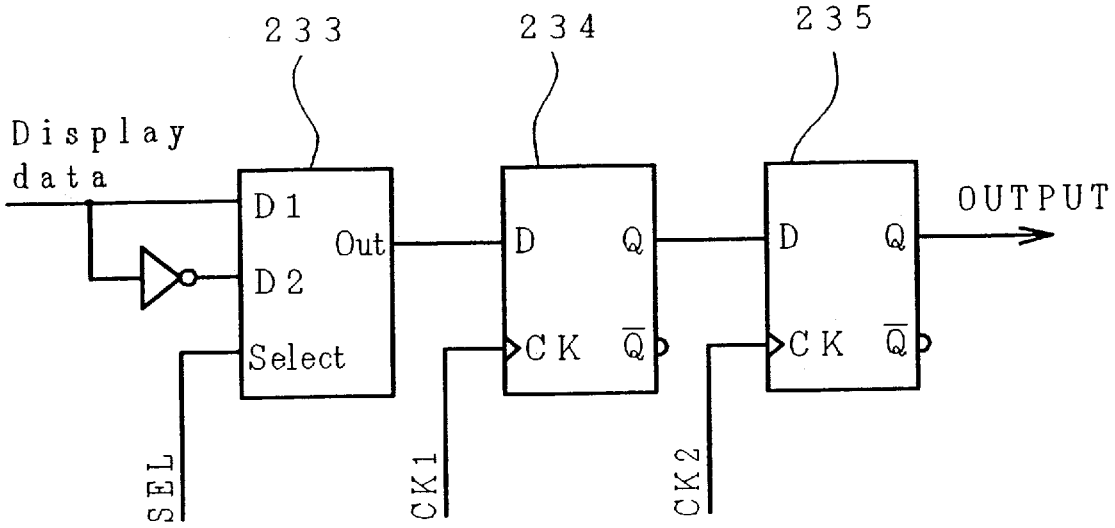
FIG. 24 is a diagram showing the circuit configuration of a data processing unit of FIG. 23.

FIG. 24 shows the outline configuration of the data processing unit of FIG. 23.

Figure 25:
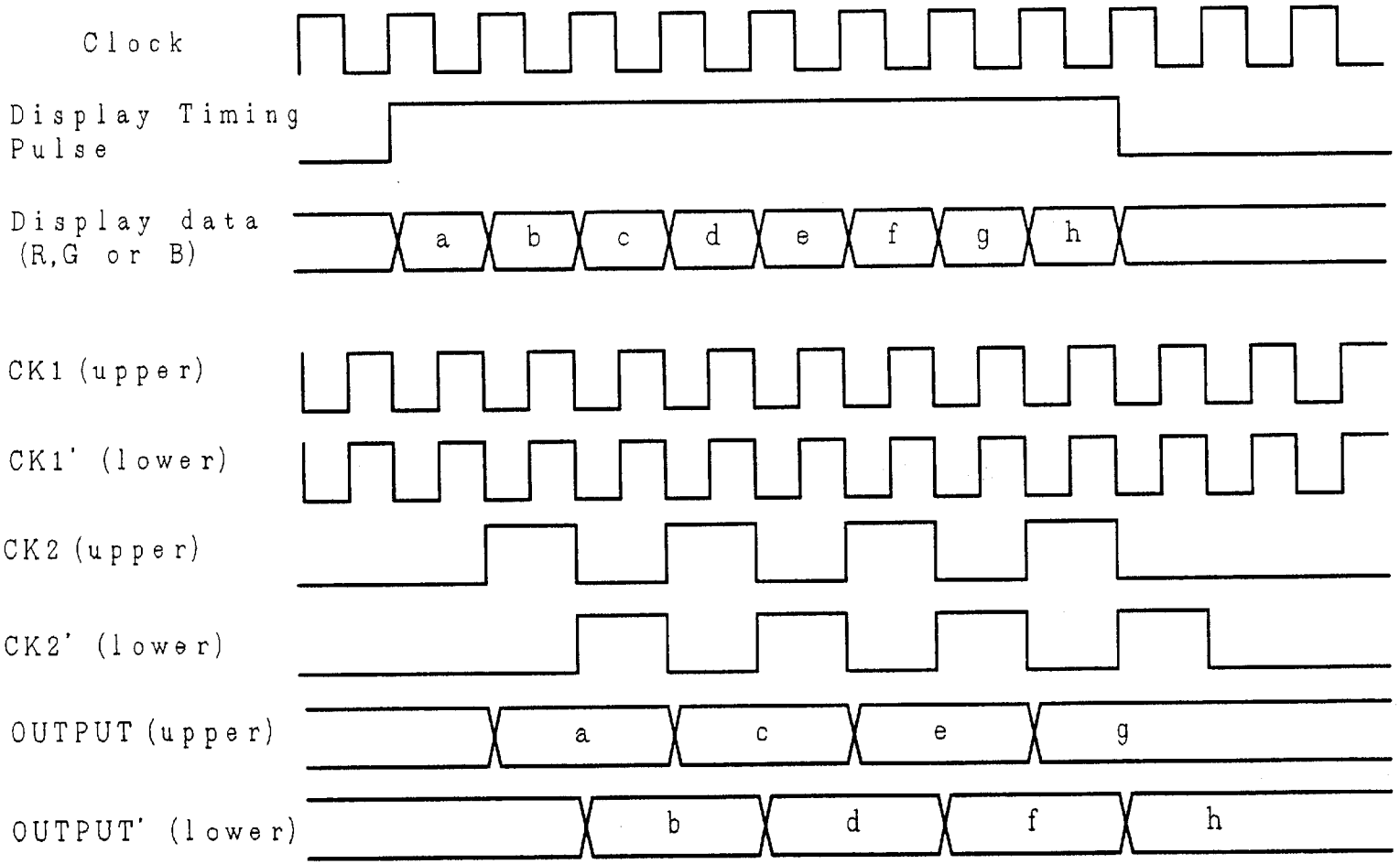
FIG. 25 is a timing chart of the data processing unit of FIG. 23.

FIG. 25 represents a timing chart of the data processing unit of FIG. 23.

In FIG. 23, the control signal processing/generation unit 230, in response to the control signals (clock, display timing signal, synchronizing signal) from the computer, produces control signals and send them to the data processing unit (231, 232) and the liquid crystal drivers (drain driver 211, gate driver 206 not shown).

FIG. 24 shows the data processing unit (231, 232) of FIG. 23, which comprises a cascade of a multiplexer 233, a D-type flip-flop 234 to which clock CK1 is supplied, and a D-type flip-flop 235 to which clock CK2 is supplied. The data processing unit (231, 232) receives display data from the computer and, in response to the clock signal from the control signal processing/generation unit 230, outputs display data to the drain driver 211.

The multiplexer 233 is same as the logic processing circuit 227 shown in FIG. 20, and controls the display data inverted or not inverted by the select signal SEL.

As is evident from the timing chart of FIG. 25, the clock signal (CK2) supplied to the upper data processing unit 231 is 180° out of phase with the clock signal (CK2) supplied to the lower data processing unit 232. The clock signal (CK2) has a period two times that of the clock signal (Clock) from the computer.

The upper and lower data processing units (231, 232) work in the following manner. The display data, which was taken into the D-type flip-flop 234 in response to the clock signal (CK1) of the same frequency as the clock signal from the computer, is alternately sent (display data a, c, e, . . . ) to the D-type flip-flop 235 of the upper data processing unit 231 in response to the clock signal (CK2) and output onto the upper data bus. Likewise, the D-type flip-flop 235 of the lower data processing unit 232 takes in every second display data (b, d, f, . . . ) in response to the clock signal (CK2) and outputs them onto the lower data bus.

The display data consists of 18 bits, 6 bits for each primary color.

In the TFT liquid crystal display module of the sixth embodiment, the data processing unit (231, 232) is also used to activate the drain driver 211, so that the overall power consumption of the display controller 201 is not different from that of the conventional device.

Since the control signal processing/generation unit 230 need not perform data processing, the TFT liquid crystal display module of the sixth embodiment has a reduced package size. That is, the display controller 201 of this embodiment has only 50 or fewer terminals, while the conventional display controller has 100 to 150 terminals.

The TFT liquid crystal display module of the sixth embodiment incorporates the multiplexer 233 because the IC used in the drain driver 211 is required to invert data in synchronism with the AC cycle of voltage applied to the liquid crystal.

When there is no need to invert the data and the data can be taken in at one time, the data processing unit (231, 232) may use a standard semiconductor integrated circuit.

Figure 26:
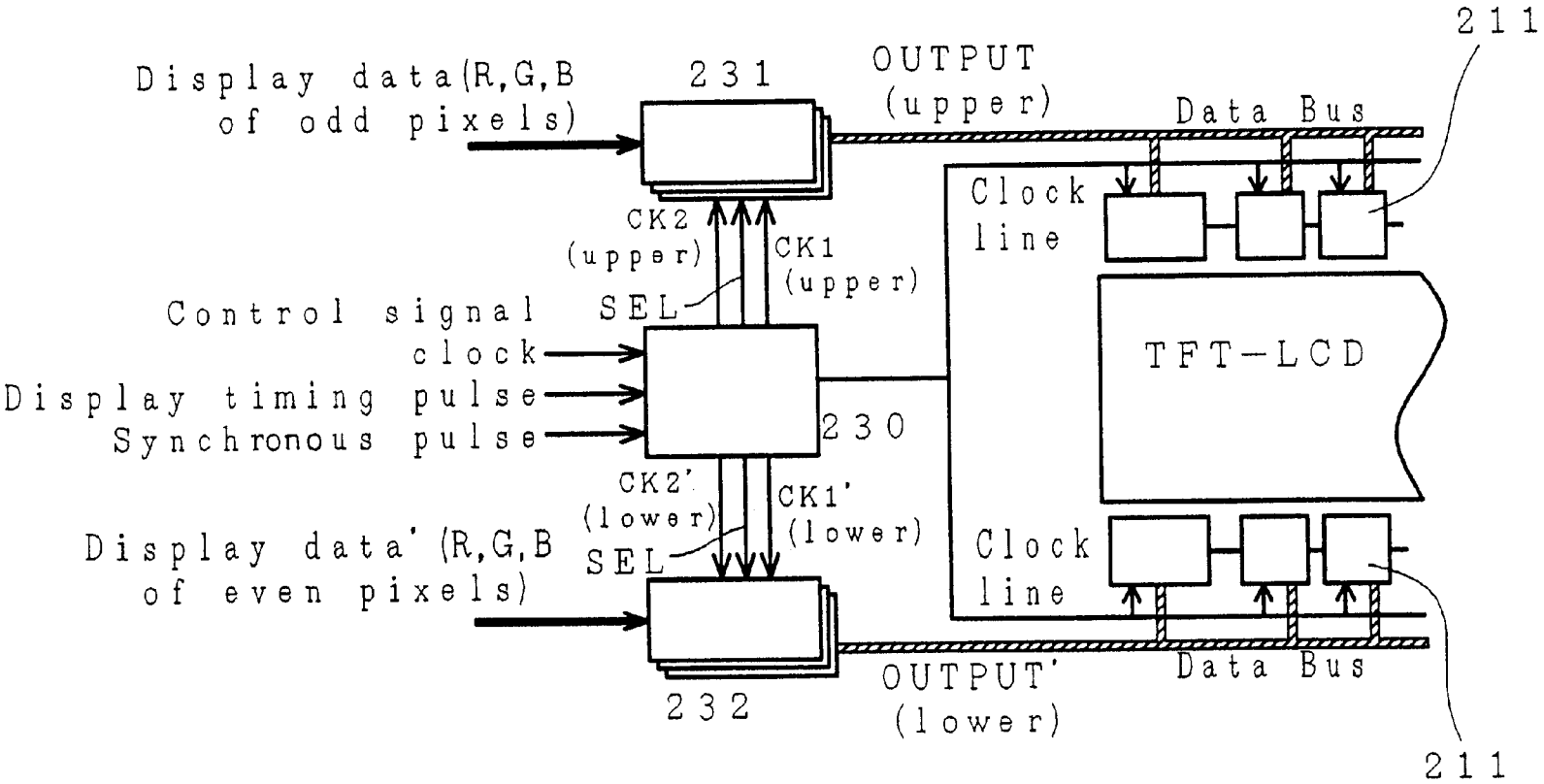
FIG. 26 is a block diagram showing the outline configuration of a display controller of the TFT liquid crystal display module as a seventh embodiment of the liquid crystal display device of this invention.

FIG. 26 is a block diagram showing the outline configuration of the display controller of the TFT liquid crystal display module as a seventh embodiment of the liquid crystal display device according to this invention.

The seventh embodiment is the TFT liquid crystal display module of the previous sixth embodiment in which two pixels of display data from the computer are input parallelly to the upper and lower data processing units. The seventh embodiment also represents a high resolution TFT liquid crystal display module.

Figure 27:
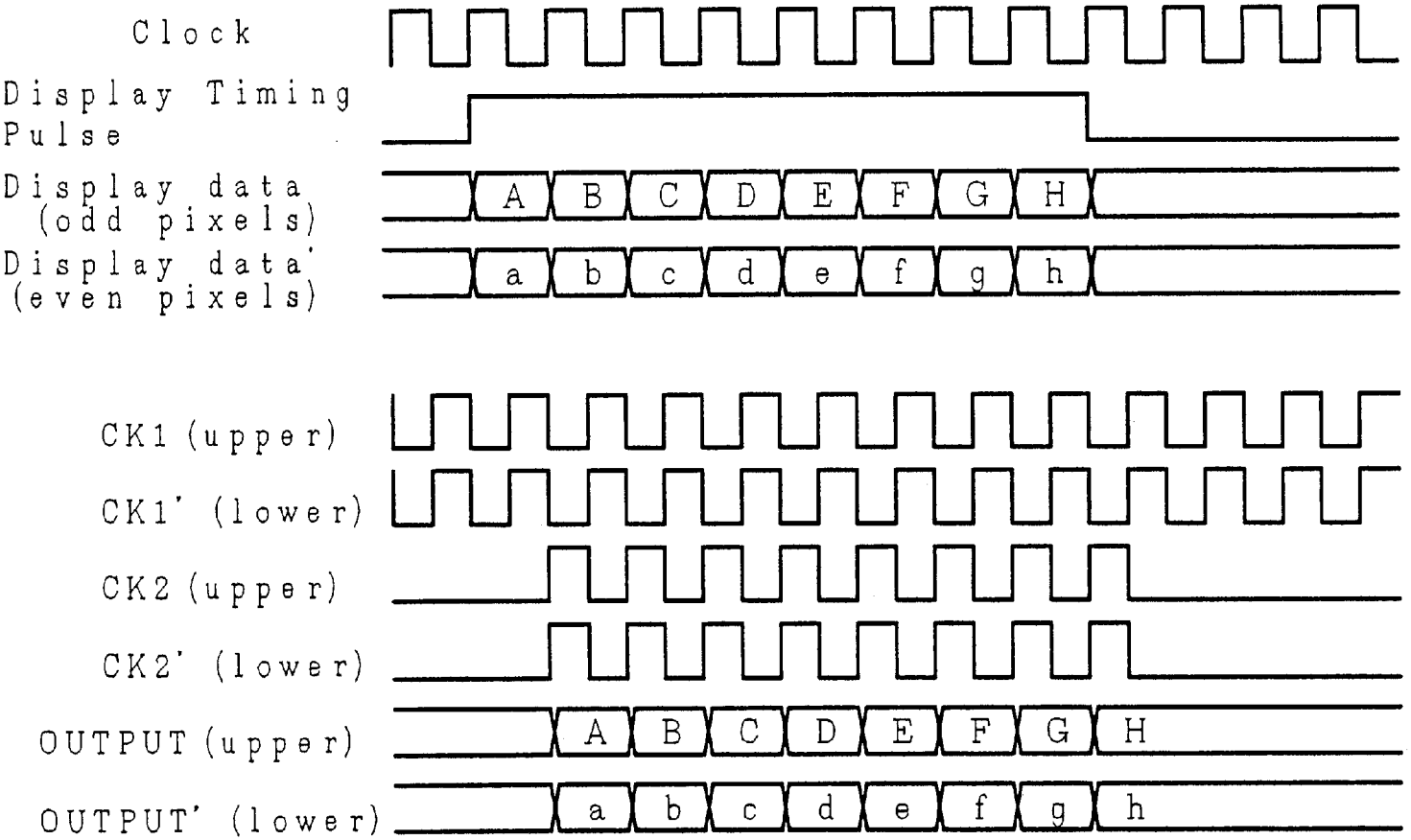
FIG. 27 is a timing chart of the data processing unit of FIG. 26.

FIG. 27 is a timing chart of the data processing unit of FIG. 26.

In the TFT liquid crystal display module of the seventh embodiment, two pixels of display data from the computer are parallelly supplied to the upper and lower data processing units (231, 232), so that the clock signals (CK1, CK2) have the same frequency as that of the clock signal (Clock) from the computer, as can be seen from the timing chart of FIG. 27.

Hence, in the upper and lower data processing units (231, 232), the display data is taken into the D-type flip-flops 234 in response to the clock signal (CK1) of the same frequency as that of the clock signal from the computer, and then the display data (A, B, C, . . . ) and (a, b, c, . . . ) are parallelly supplied in response to the clock signal (CK2) to the D-type flip-flops 235, which then output them onto the upper and lower data buses.

In the TFT liquid crystal display modules of the sixth and seventh embodiments, the data processing units (231, 232) may be constructed of a plurality of semiconductor integrated circuits. Further, the control signal processing/generation unit 230 may be formed in such a way as to offer greater number of grey-scale levels, say 256 levels, and higher resolution. This eliminates the need for developing a new control signal processing/generation unit 230 that can realize an increased number of grey-scale levels.

Because the heating of the semiconductor integrated circuit can be suppressed as mentioned earlier, the device can be realized with a small package of semiconductor integrated circuit such as TSOP (thin small outline package).

In the TFT liquid crystal display module of the preceding embodiments, as described above, the display controller 201 of the conventional TFT liquid crystal display module is constructed of a plurality of semiconductor integrated circuits or its function is realized with a plurality of semiconductor integrated circuits, so that the power consumption can be distributed.

Figure 28:
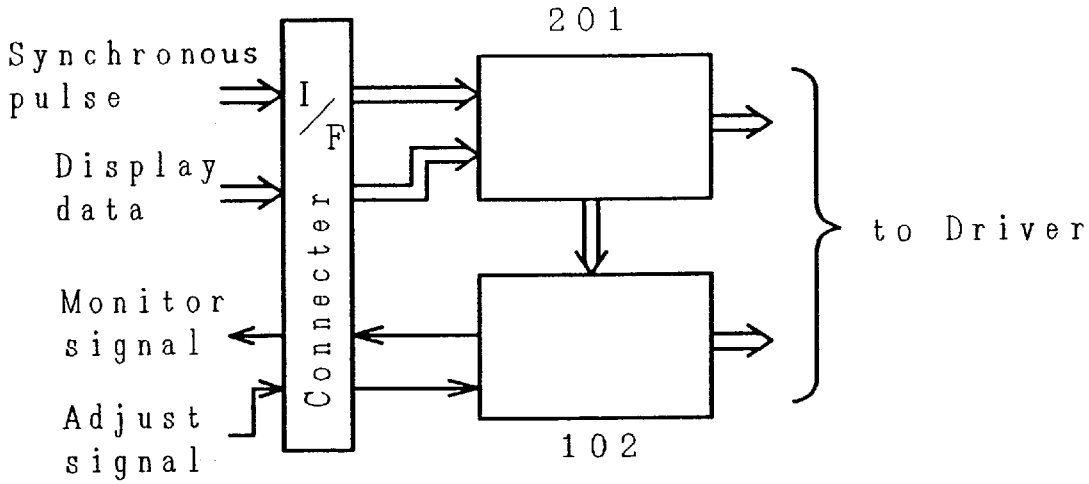
FIG. 28 is a diagram showing that an internal drive circuit of the TFT liquid crystal display module can be adjusted from a particular terminal provided to the I/F connector.

As shown in FIG. 28, in the TFT liquid crystal display modules of the preceding embodiments, it is possible to provide a particular terminal to the I/F connector of the printed circuit board (interface board) that mounts the display controller 201, and to pick up and monitor a signal voltage from among a variety of signal voltages of the power supply unit 102 in the TFT liquid crystal display module, such as DC level of the common signal voltage, amplitude level of the common signal voltage, DC level of the gate-on and gate-off signal voltage, amplitude level of the gate-on and gate-off signal voltage, and grey-scale voltage.

By using the I/F connector, signal voltages of the power supply unit 102 of the TFT liquid crystal display module can be monitored, simplifying the adjustment work in the manufacture and final inspection process and thereby reducing the overall work load.

As shown in FIG. 28, in the TFT liquid crystal display module of the preceding embodiments, it is also possible to adjust the DC level of the common signal voltage from outside by connecting the particular terminal of the I/F connector to a particular location in the drive circuit of the TFT liquid crystal display module, for example, to the inverting input terminal of operational amplifier OP4 of the common driver 203 shown in FIG. 11 and then applying a voltage from outside.

By inserting the I/F connector and applying the adjust voltage from outside, the testing of the drive circuit of the TFT liquid crystal display module can be done easily from outside without having to overhaul the TFT liquid crystal display module.

In the TFT liquid crystal display module of the preceding embodiments, the display data has six bits for each color, i.e., 64 shades. However, there may be a case where the display data sent from the computer is made up of less than six bits, for instance, four bits for each color.

In that case, the four-bit display data of each color fed from the computer needs to be transformed into six-bit display data.

Figure 29:
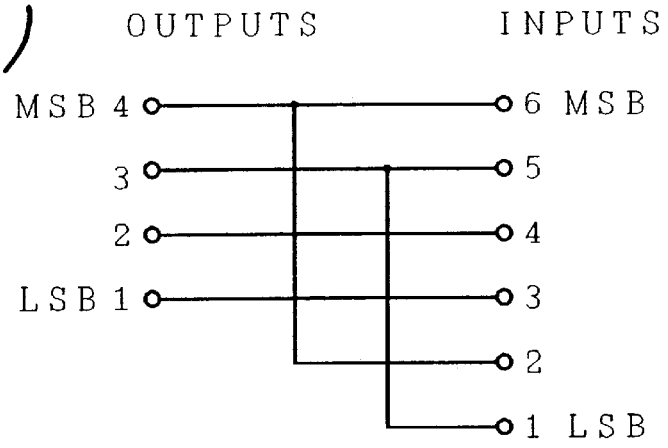
FIGS. 29(*a*)–29(*c*) are diagrams explaining the digital-to-digital conversion method of this invention.
Figure 29:
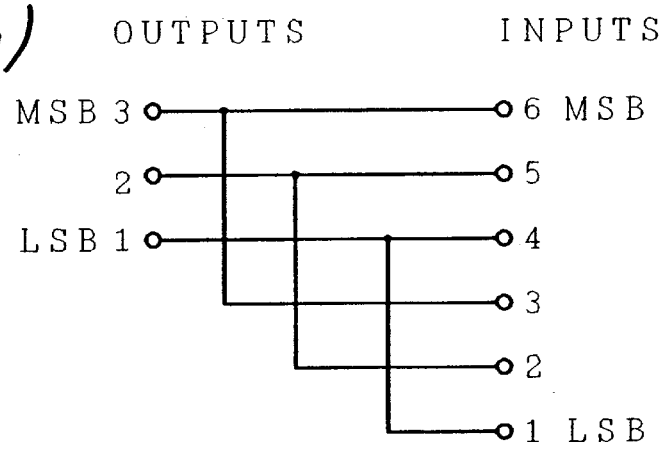
Figure 29:
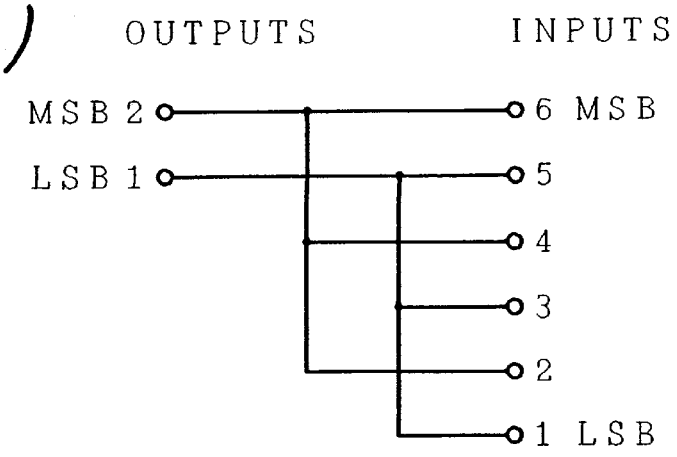

The present invention therefore proposes an optimum digital—digital conversion method for the above case, as shown in FIG. 29(*a*).

In FIG. 29(*a*), four output bits represent the four bits of display data for each color output from the computer. Six input bits represent the six bits of display data for each color input into the drain driver 211 of the TFT liquid crystal panel (TFT-LCD) of the preceding embodiments.

In the digital—digital conversion method of FIG. 29(*a*), the four-bit display data from the computer is used as the higher-order four bits of 6-bit display data to be input to the drain driver 211 of the TFT liquid crystal display panel (LCD), and the higher-order two bits of the 4-bit data from the computer are fed to the remaining lower two bits of the 6-bit data fed to the drain driver 211.

FIG. 30 shows bit strings, which are converted from 4-bit data to 6-bit data by the digital—digital conversion method of FIG. 29(*a*).

As is seen from FIG. 30, the digital—digital conversion method of FIG. 29(*a*) produces bit strings whose values are thinned out between an all-bit low (0, 0, 0, 0, 0, 0) and an all-bit high (1, 1, 1, 1, 1, 1).

Hence, compared with the conventional method which fixes the lower bits that lack the display data to the low or high, the digital—digital conversion method of FIG. 29(*a*) enables the display of 100% white or black and also a linear grey-scale display.

While the conversion from four bits to six bits has been shown as an example of the digital-digital conversion method of FIG. 29(*a*), other conversion procedures may be used.

For example, when a 3-bit computer output is converted into six bits for input into the liquid crystal module, a circuit of FIG. 29(*b*) may be used to provide a linear display of grey-scale levels. When a 2-bit computer output is converted into six bits for input into the liquid crystal module, a circuit of FIG. 29(*c*) can be used.

FIG. 31 to FIG. 38 represent the TFT liquid crystal display module of an eighth embodiment of this invention, showing the circuit configuration of the actual liquid crystal drive circuit including the connections between each IC and the I/F (interface) connector.

Figure 31:
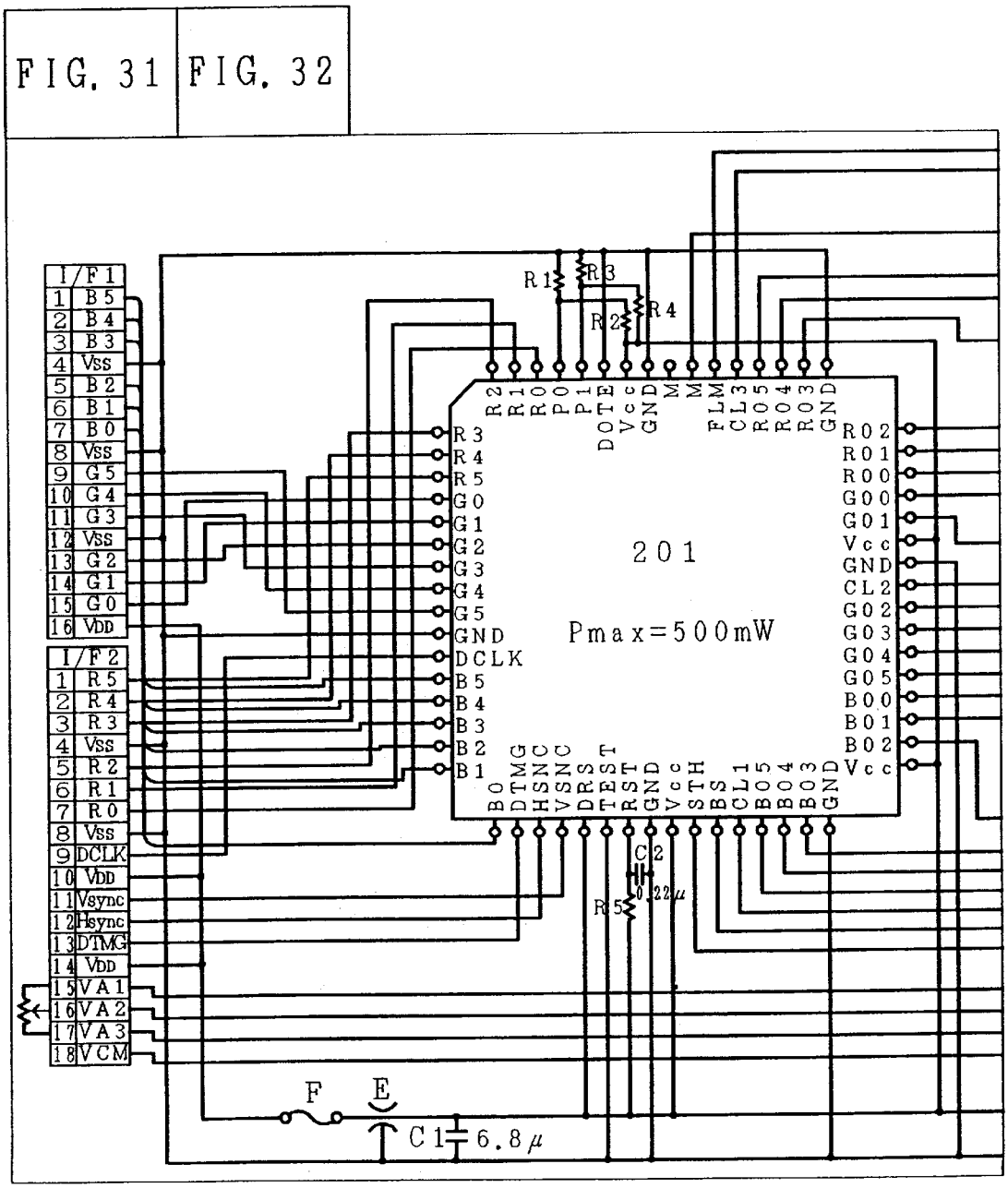
FIG. 31 is a circuit diagram representing a TFT liquid crystal display module of an eighth embodiment of this invention, showing the circuit configuration of an actual liquid crystal drive circuit including connections between ICs and I/F connectors.
Figure 32:
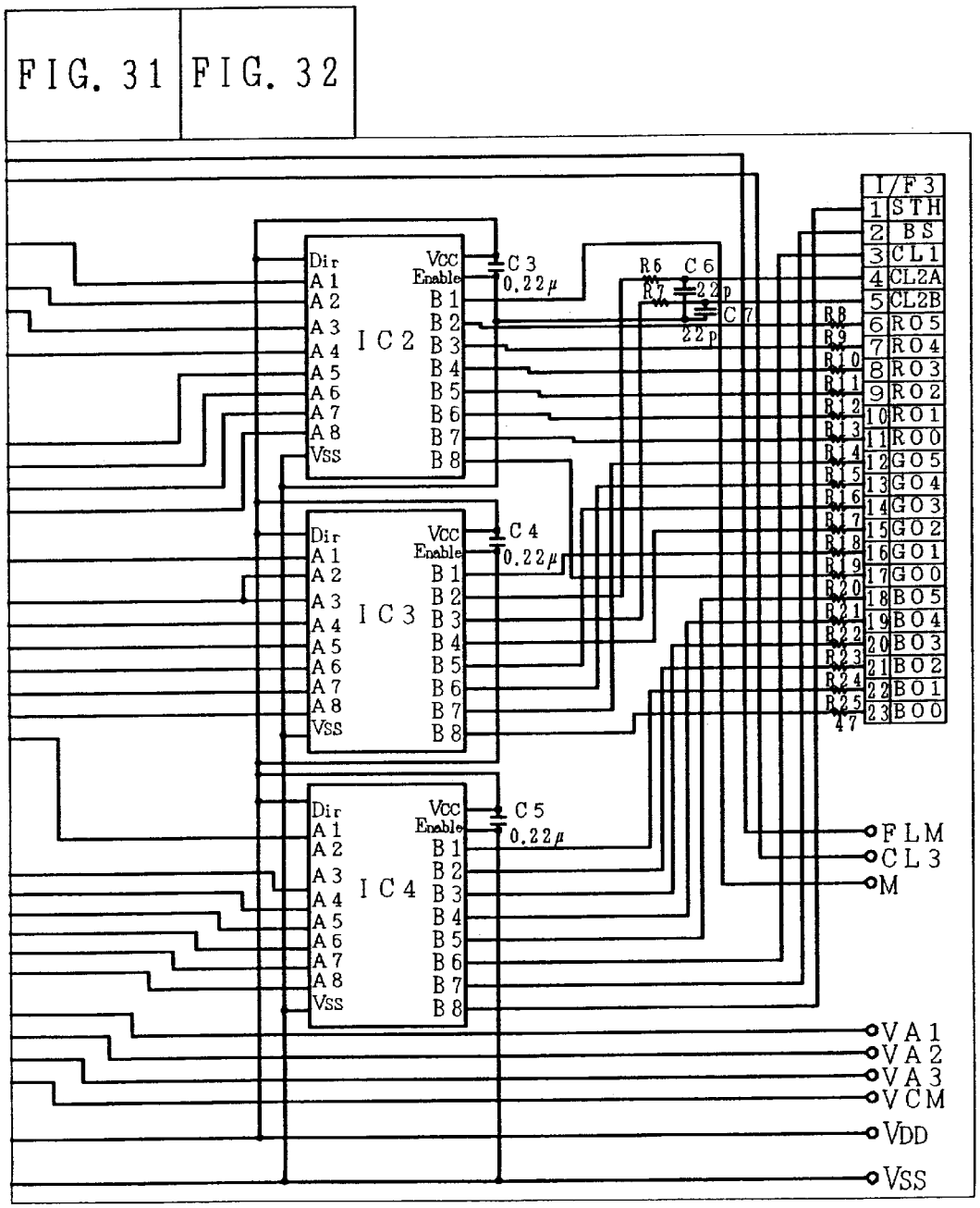
FIG. 32 is a circuit diagram representing a TFT liquid crystal display module of an eighth embodiment of this invention, showing the circuit configuration of an actual liquid crystal drive circuit including connections between ICs and I/F connectors.
Figure 33:
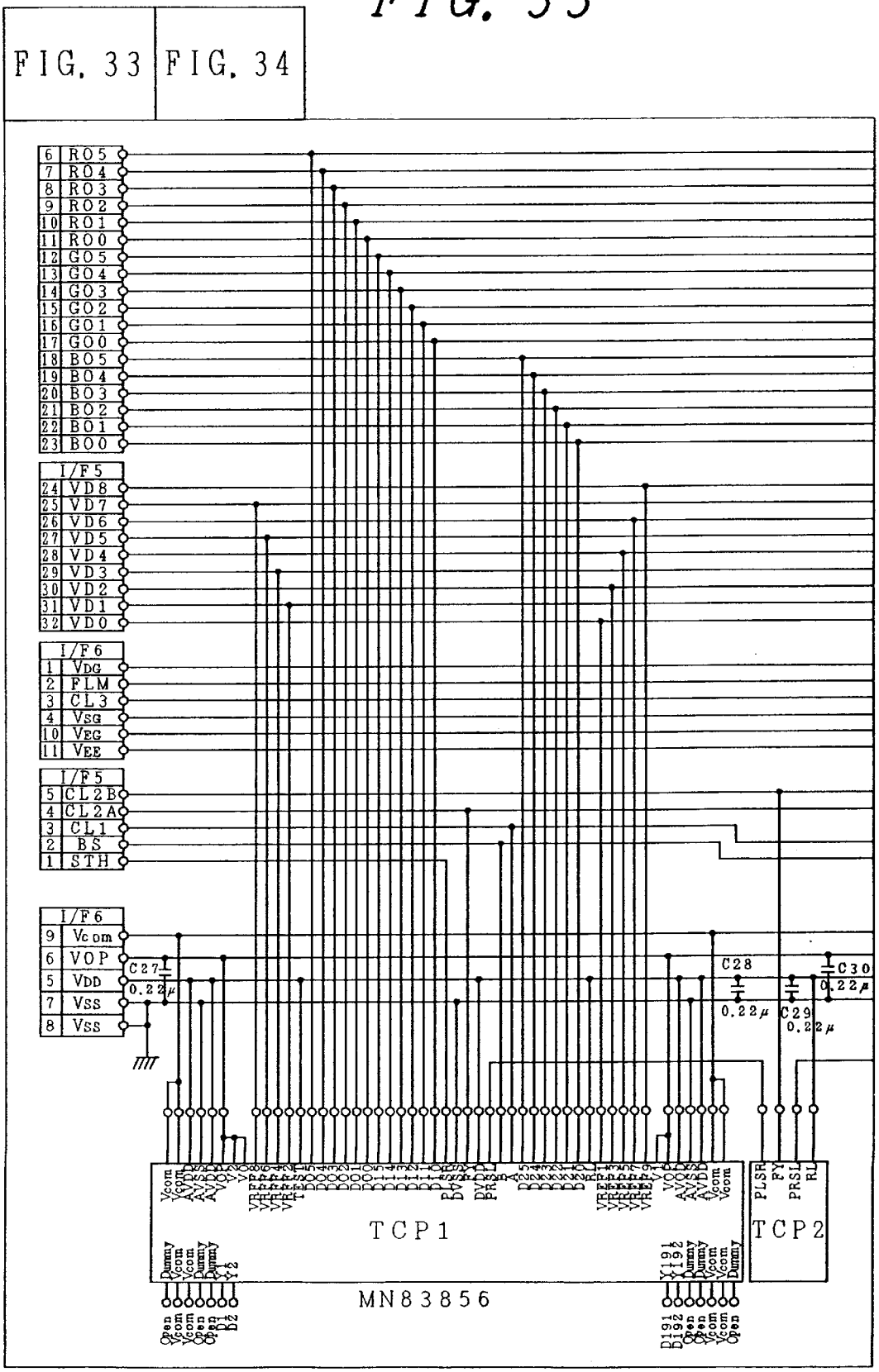
FIG. 33 is a circuit diagram representing a TFT liquid crystal display module of an eighth embodiment of this invention, showing the circuit configuration of an actual liquid crystal drive circuit including connections between ICs and I/F connectors.
Figure 34:
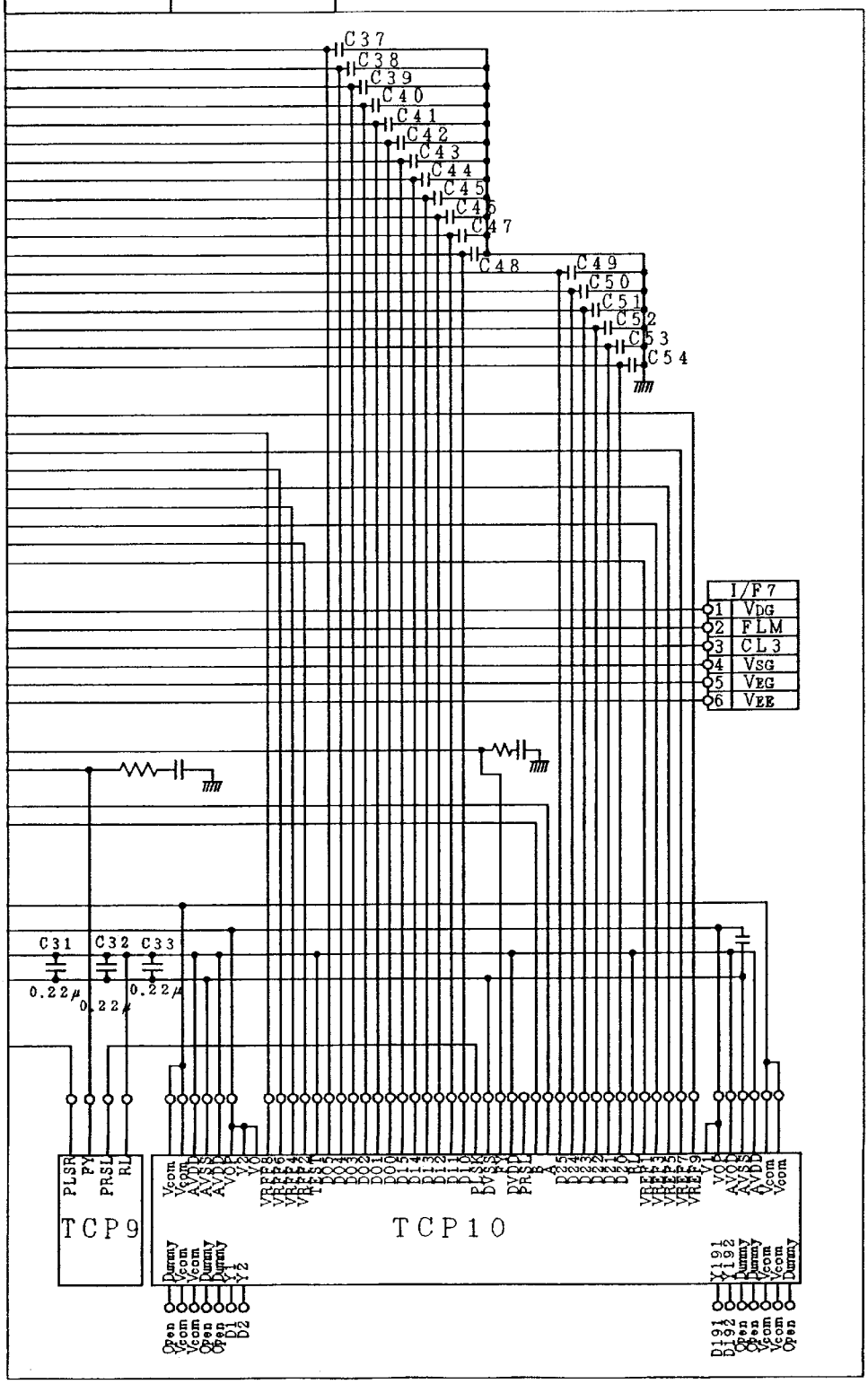
FIG. 34 is a circuit diagram representing a TFT liquid crystal display module of an eighth embodiment of this invention, showing the circuit configuration of an actual liquid crystal drive circuit including connections between ICs and I/F connectors.
Figures 35, 36:
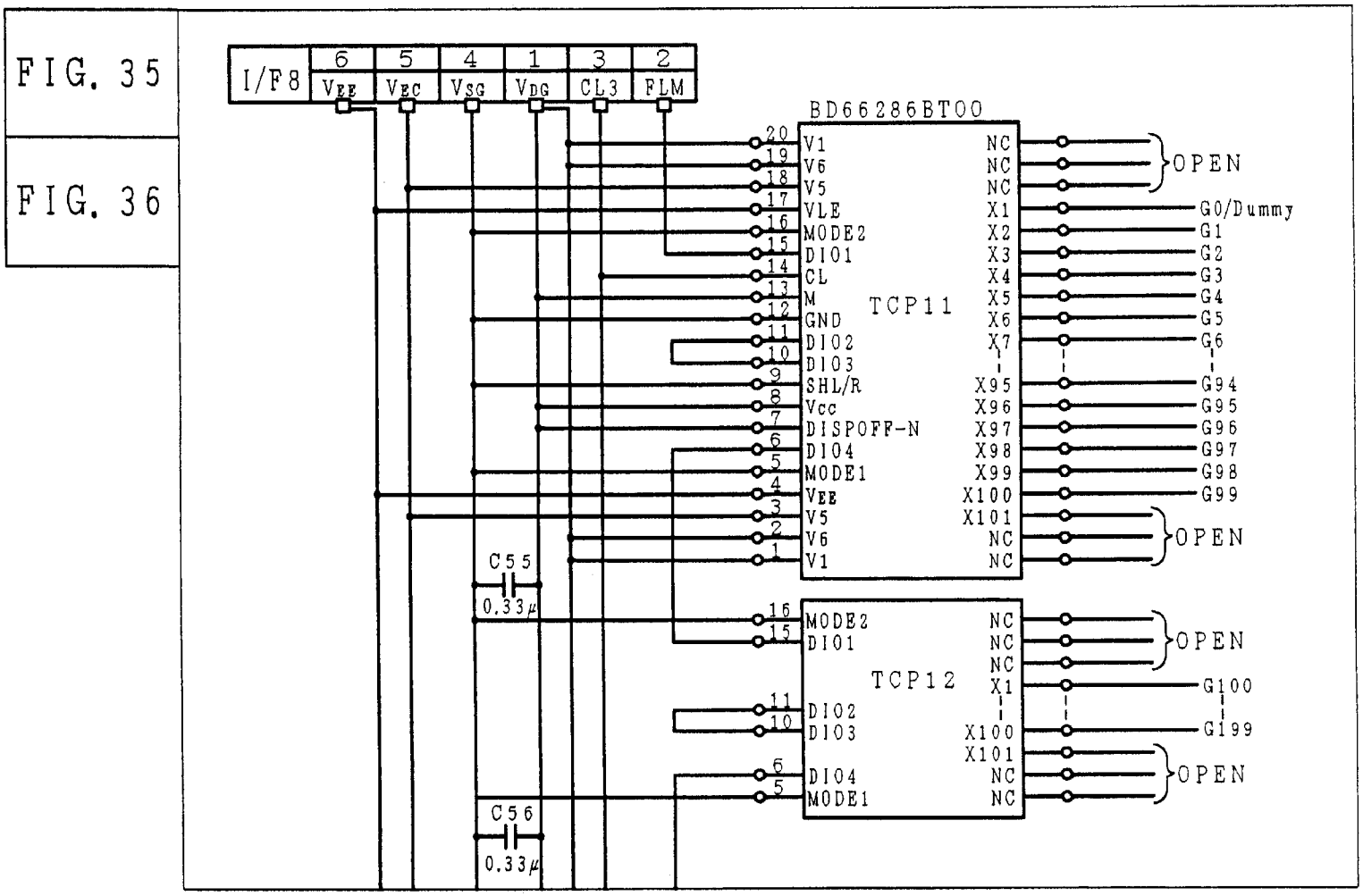
FIG. 35 is a circuit diagram representing a TFT liquid crystal display module of an eighth embodiment of this invention, showing the circuit configuration of an actual liquid crystal drive circuit including connections between ICs and I/F connectors.
FIG. 36 is a circuit diagram representing a TFT liquid crystal display module of an eighth embodiment of this invention, showing the circuit configuration of an actual liquid crystal drive circuit including connections between ICs and I/F connectors.
Figures 35, 36:
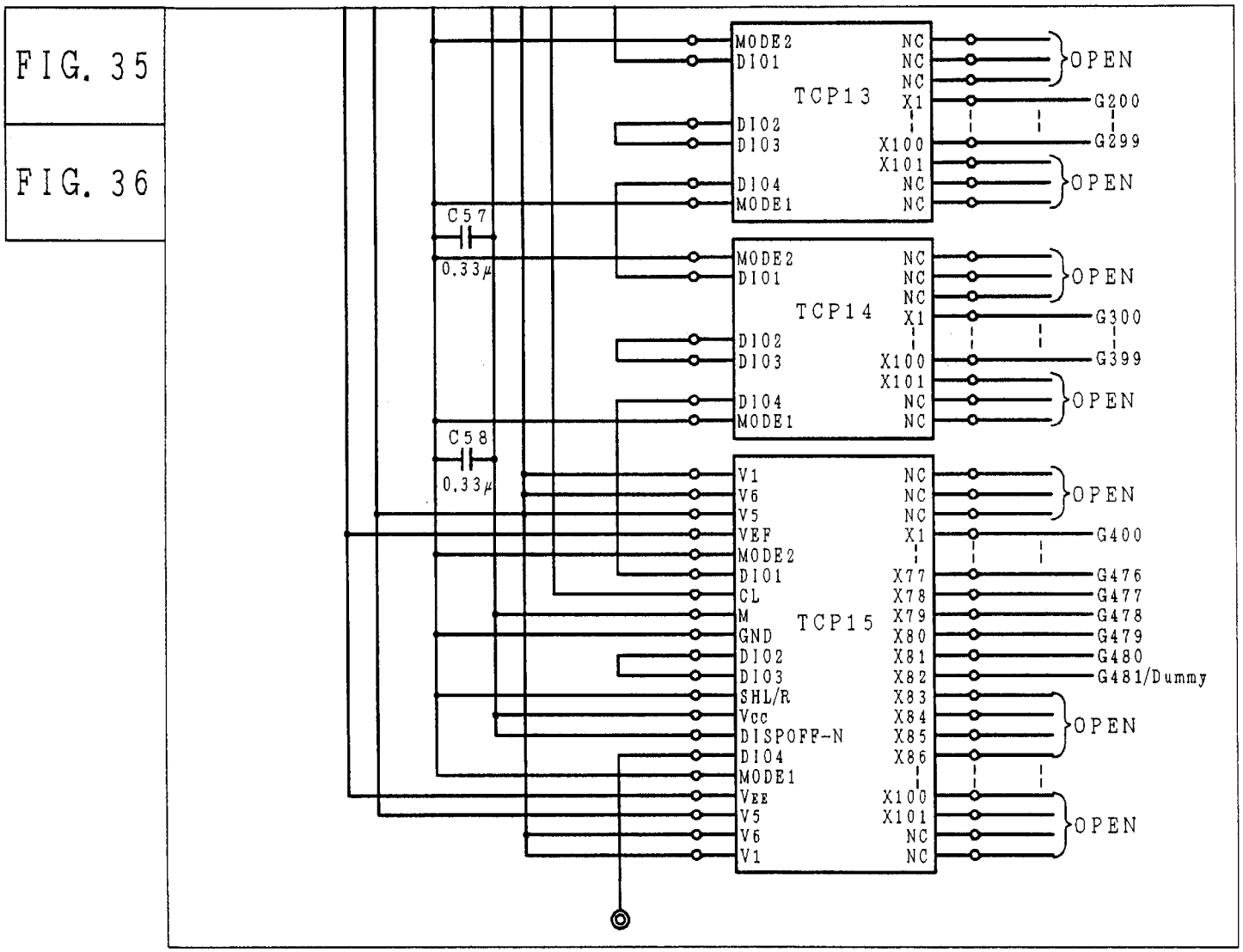
Figure 37:
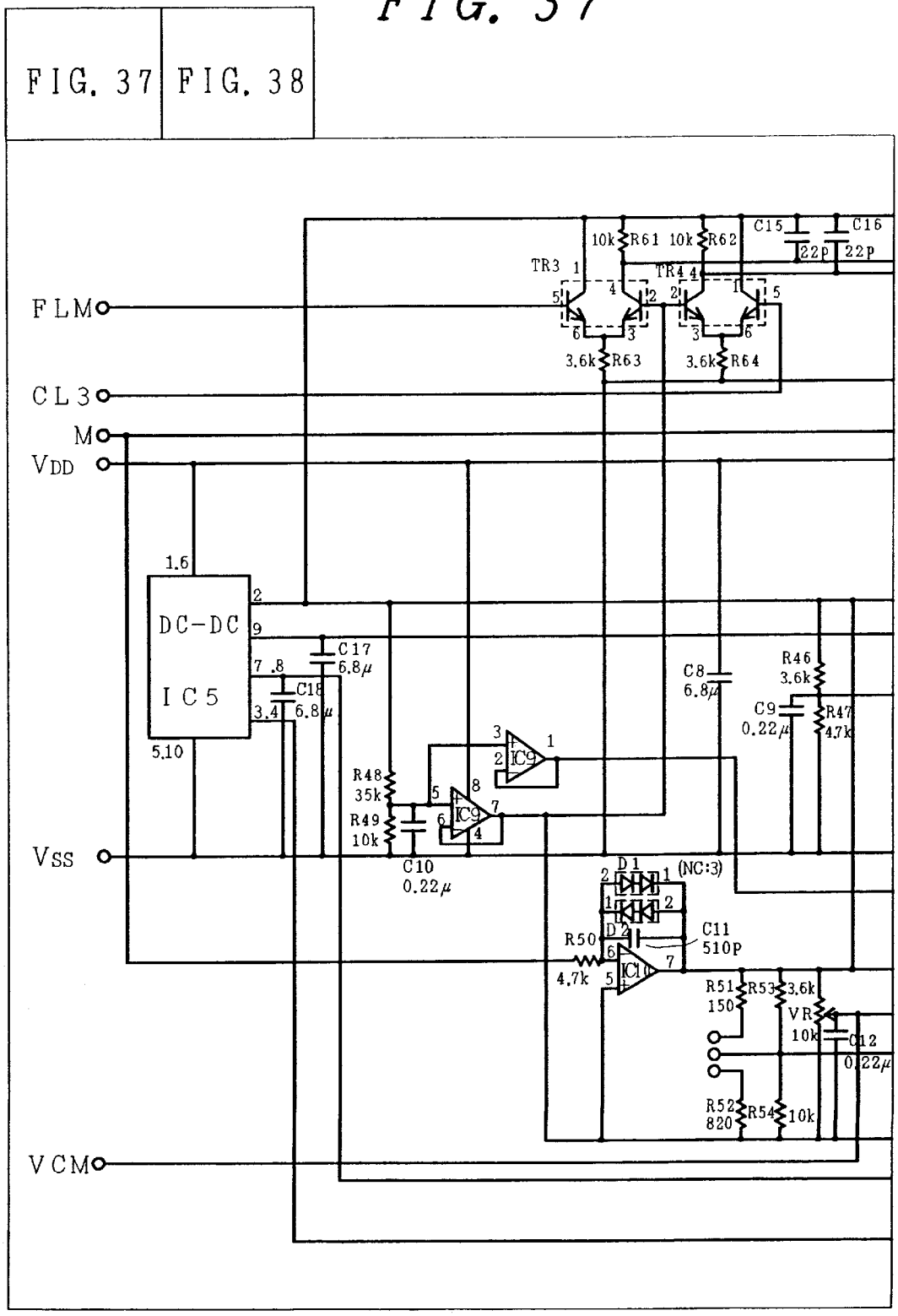
FIG. 37 is a circuit diagram representing a TFT liquid crystal display module of an eighth embodiment of this invention, showing the circuit configuration of an actual liquid crystal drive circuit including connections between ICs and I/F connectors.
Figure 38:
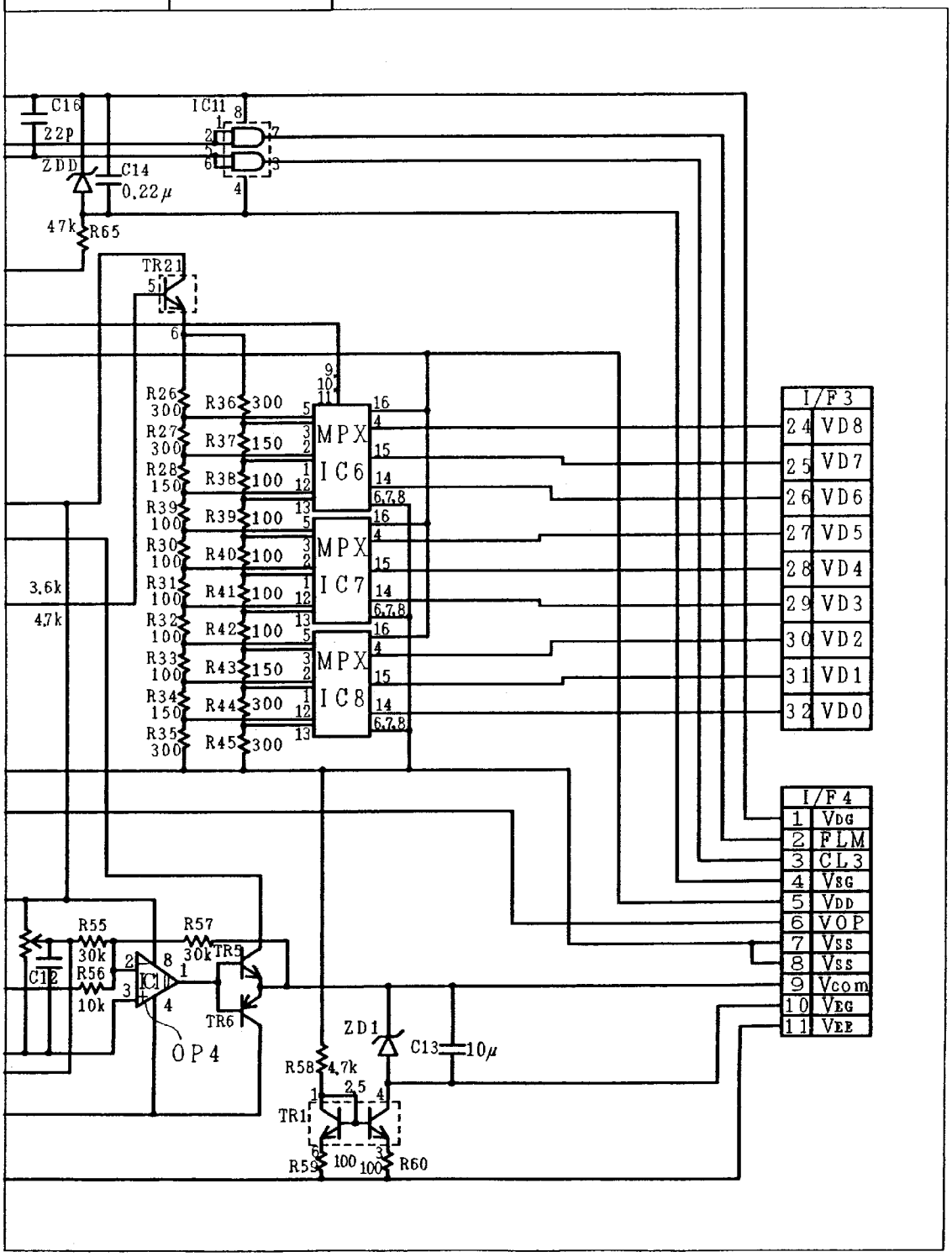
FIG. 38 is a circuit diagram representing a TFT liquid crystal display module of an eighth embodiment of this invention, showing the circuit configuration of an actual liquid crystal drive circuit including connections between ICs and I/F connectors.

FIGS. 31 and 32 show the controller unit 101 of FIG. 1, FIGS. 33 and 34 show the drain driver unit 103 of FIG. 1, FIGS. 35 and 36 show the gate driver unit 104 of FIG. 1, and FIGS. 37 and 38 show the power supply unit 102 of FIG. 1.

The eighth embodiment includes a part of the preceding embodiments. For example, in FIGS. 31 and 32, the display controller 201 is constructed of one LSI, and buffer circuits (IC2, IC3, IC4) are inserted between the display controller 201 and the drain driver 211.

Further, the clock signal (CL2) is divided into two systems, which are supplied from the independent buffer circuits in the IC3 to alternate drain drivers IC.

The I/F connectors 15–17 of FIG. 31 are terminals for connecting a resistor for viewing angle adjustment such as shown in FIG. 13. The I/F connector 18 is connected to a non-inverting terminal of the operational amplifier OP4 of FIG. 38 to monitor the DC level and the amplitude level of the common signal voltage or to adjust from outside the DC level of the common signal voltage by applying a voltage from outside.

The embodiments of this invention have been described in detail. It is noted that the invention is not limited to these embodiments but that a variety of modifications may be made without departing from the spirit of the invention.

EFFECT OF THE INVENTION

Representative advantages of this invention may be briefly summarized as follows.

(1) In the TFT liquid crystal display, the common electrode is driven by a trapezoidal AC drive voltage, and thus the peak current of the drive transistor can be suppressed, which in turn minimizes the drive circuit of the TFT liquid crystal display, reducing the external size of the display.

(2) In the TFT liquid crystal display, the gate electrode is driven by a DC gate-on voltage and a trapezoidal gate-off voltage, and thus the circuit configuration becomes simple, reducing the external size of the TFT liquid crystal display.

(3) In the TFT liquid crystal display, the normal gate drive voltage is applied to the dummy gate signal line, and thus the contrast of the line pixels at the ends can be improved.

(4) In the TFT liquid crystal display, a capacitor is connected between the positive supply and the output terminal of the level shift circuit to cancel the noise superposed on the positive supply, and thus it is possible to prevent erroneous operation of the circuit connected behind the level shift circuit, thus improving the noise immunity.

(5) In the TFT liquid crystal display that AC-drives the common electrode, the amplitude of the AC drive voltage applied to the common electrode is changed, and thus the viewing angle adjustment on the TFT liquid crystal display can be made with a relatively simple circuit configuration, which in turn simplifies the drive circuit of the TFT liquid crystal display, reducing the external size of the display.

(6) In the grey-scale reference voltage generation circuit of the TFT liquid crystal display, the number of intermediate voltages to be interpolated between the reference voltages is increased for a region where the applied voltage-transmission factor characteristic of the liquid crystal is relatively linear, and the number of intermediate voltages to be interpolated between the reference voltages is reduced for a region where the applied voltage-transmission factor characteristic of the liquid crystal is non-linear. It is therefore possible to produce a gamma-compensated voltage suited for a particular applied voltage-transmission factor characteristic of the liquid crystal and therefore a good grey-scale display without having to increase the number of external reference voltages.

(7) In the TFT liquid crystal display, the drain driver is arranged only on one side, upper or lower, of the liquid crystal display panel, and thus the area of the frame edge of the liquid crystal display panel can be reduced, allowing the display area to be increased compared to the external size of the liquid crystal display device.

(8) In the TFT liquid crystal display, the drain driver is arranged only on one side, upper or lower, of the liquid crystal display panel and two systems of clock signal are supplied to the drain driver, and thus the supply of a stable clock signal is assured.

(9) In the TFT liquid crystal display, the buffer circuit is inserted between the display controller and at least one of the gate drive circuit and drain drive circuit, and thus the power consumption of the semiconductor integrated circuit making up the display controller can be distributed, preventing destruction of the semiconductor integrated circuit.

(10) In the TFT liquid crystal display, the display controller is constructed of a plurality of semiconductor integrated circuits, and thus the power consumption of the display controller can be distributed, preventing destruction of the semiconductor integrated circuits making up the display controller.

(11) In the TFT liquid crystal display, the connector is provided with a particular terminal, which is connected to a particular location in each drive circuit of the TFT liquid crystal display. It is therefore possible to monitor a variety of signal voltages at that particular location in the drive circuit of the TFT liquid crystal display simply by inserting the connector, making it possible to simplify the adjustment work in the manufacture and final inspection process and thereby reduce the work load.

Simply by inserting the connector, the adjust voltage can be applied from outside to a particular location in each drive circuit of the TFT liquid crystal display, thus allowing the drive circuit of the TFT liquid crystal display module to be tested easily from outside.

(12) Because higher-order n bits of the display data for the TFT liquid crystal display use n-bit display data from the computer and because the remaining lower-order (m−n) bits of the TFT liquid crystal display use higher-order (m−n) bits of the n-bit display data from the computer, it is possible to produce bit strings whose values are thinned out between an all-bit low and an all-bit high.

This allows 100% white or black to be displayed, providing a linear grey-scale display.

What is claimed is:

1. A TFT liquid crystal display comprising:

a TFT liquid crystal display panel including an array of pixels including a thin-film transistor and a pixel electrode arranged in a matrix, a common electrode, a liquid crystal provided between the array of the pixel electrodes and the common electrode, a plurality of gate signal lines arranged in rows and connected with gate electrodes of the thin-film transistors in rows, and a plurality of drain signal lines arranged in columns and connected with drain electrodes of the thin-film transistors in columns;

a gate drive circuit for driving the plurality of gate signal lines of the TFT liquid crystal display panel;

a drain drive circuit for driving the plurality of drain signal lines of the TFT liquid crystal display panel;

a common drive circuit for driving the common electrode;

a grey-scale reference voltage generation circuit; and a display controller for controlling the circuits in response to control signals and display data from a computer unit;

wherein the drain drive circuit generates intermediate voltages between a plurality of grey-scale reference voltages being generated from the grey-scale reference voltage generation circuit, and the intermediate voltages and the grey-scale reference voltages are applied to the drain signal lines to provide multiple grey-scale display;

wherein the grey-scale reference voltage generation circuit generates a plurality of the grey-scale reference voltages such that the potential difference between the grey-scale reference voltages in a range of service voltage where an applied voltage-transmission factor characteristic of liquid crystal is non-linear is smaller than the potential difference between the grey-scale reference voltages in a range of service voltage where the applied voltage-transmission factor characteristic is relatively linear; and wherein the number of intermediate voltages generated by the drain drive circuit from the grey-scale reference voltages in the service voltage range where the applied voltage-transmission factor characteristic of liquid crystal is non-linear is smaller than the number of intermediate voltages generated from the grey-scale reference voltages in the service voltage range where the applied voltage-transmission factor characteristic of the liquid crystal is relatively linear.

2. A TFT liquid crystal display according to claim 1, further comprising:

a gate driver board on which the gate drive circuit is mounted;

a drain driver board on which the drain drive circuit is mounted;

a power supply board on which the common drive circuit and a power supply circuit are mounted; and an interface board on which the display controller is mounted;

wherein the gate driver board, the drain driver board, the power supply board, and the interface board are arranged outside the TFT liquid crystal display panel; and wherein the drain driver board is installed at only one side of the TFT liquid crystal display panel perpendicular to the side where the gate driver board is installed.

3. A TFT liquid crystal display according to claim 2, wherein the display controller makes an amount of output display data, which is based on an amount of input display data, equal to the amount of input data for the drain driver board.

4. A TFT liquid crystal display according to claim 3, wherein a clock signal to be sent from the display controller to the drain drive circuits is divided into a plurality of clock signals, and the divided clock signals are each transmitted to the drain drive circuits.

5. A TFT liquid crystal display comprising:

a TFT liquid crystal display panel including an array of pixels including a thin-film transistor and a pixel electrode arranged in a matrix, a common electrode, a liquid crystal provided between the array of pixel electrodes and the common electrode, a plurality of gate signal lines arranged in rows and connected with gate electrodes of the thin-film transistors in rows, and a plurality of drain signal lines arranged in columns and connected with drain electrodes of the thin-film transistors in columns;

a gate drive circuit for driving the plurality of gate signal lines of the TFT liquid crystal display panel;

a drain drive circuit for driving the plurality of drain signal lines of the TFT liquid crystal display panel;

a common drive circuit for driving the common electrode; and a display controller for controlling the circuits in response to control signals and display data from a computer unit;

wherein the TFT liquid crystal display panel further includes at least one of:

(a) a trapezoidal AC drive voltage from the common circuit being applied to the common electrode to AC-drive the common electrode;

(b) the array of pixels including the thin-film transistor, the pixel electrode, and a holding capacitance arranged in the matrix, wherein an AC drive voltage from the common drive circuit is applied to the common electrode to AC-drive the common electrode, wherein the holding capacitance is provided between the pixel electrode and the signal lines being adjacent to the pixel electrode, wherein the gate drive circuit selects a gate-on voltage or a gate-off voltage which is lower than the gate-on voltage and drives the gate signal lines, and wherein the gate-off voltage has a same phase and a same amplitude as the AC drive voltage being applied to the common electrode; and (c) a grey-scale reference voltage generation circuit.

6. A TFT liquid crystal display according to claim 5, wherein at least (c) is provided; and wherein the drain drive circuit generates intermediate voltages between a plurality of grey-scale reference voltages being generated from the grey-scale reference voltage generation circuit, and the intermediate voltage and the grey-scale reference voltages are applied to the drain signal lines to provide multiple grey-scale display;

wherein the grey-scale reference voltage generation circuit generates a plurality of the grey-scale reference voltages such that the potential difference between the grey-scale reference voltages in a range of service voltage where an applied voltage-transmission factor characteristic of liquid crystal is non-linear is smaller than the potential difference between the grey-scale reference voltages in a range of service voltage where the applied voltage-transmission factor characteristic is relatively linear; and wherein the number of intermediate voltages generated by the drain drive circuit from the grey-scale reference voltages in the service voltage range where the applied voltage-transmission factor characteristic of liquid crystal is non-linear is smaller than the number of intermediate voltages generated from the grey-scale reference voltages in the service voltage range where the applied voltage-transmission factor characteristic of the liquid crystal is relatively linear.

7. A TFT liquid crystal display according to claim 6, wherein (a) and (b) are provided.

8. A liquid crystal display device comprising:

a liquid crystal display panel including a plurality of pixels arranged in rows and columns, each of the pixels including a thin-film transistor and a pixel electrode, the thin-film transistor having a gate electrode and a drain electrode, a plurality of gate signal lines arranged in rows and connected to the gate electrodes of the thin-film transistors in respective ones of the rows of pixels, and a plurality of drain signal lines arranged in columns and connected to the drain electrodes of the thin-film transistors in respective ones of the columns of pixels;

a gate drive circuit for driving the gate signal lines; and a drain drive circuit for driving the drain signal lines;

wherein the drain drive circuit receives a plurality of grey-scale reference voltages from an external circuit, interpolates a plurality of intermediate voltages between each pair of adjacent ones of the grey-scale reference voltages, selects voltages from the grey-scale reference voltages and the intermediate voltages, and applies the selected voltages to the drain signal lines;

wherein V0 is a grey-scale reference voltage corresponding to a minimum grey-scale level, Vm is a grey-scale reference voltage corresponding to a maximum grey-scale level, and Vi is a grey-scale reference voltage that is nearest to a voltage level (Vm+V0)/2; and wherein a number of intermediate voltages interpolated between V(i−1) and Vi is different from both a number of intermediate voltages interpolated between V0 and V1, and a number of intermediate voltages interpolated between V(m−1) and Vm.

* * * * *